US006232855B1

(12) United States Patent
Malingowski et al.

(10) Patent No.: US 6,232,855 B1
(45) Date of Patent: May 15, 2001

(54) CIRCUIT INTERRUPTER WITH COVERED ACCESSORY CASE, ADJUSTABLE UNDER VOLTAGE RELAY, SELF-RETAINING COLLAR AND ONE-PIECE RAIL ATTACHMENT

(75) Inventors: Richard P. Malingowski, Finleyville; Trent A. Chontas, East Pittsburgh, both of PA (US); William C. Farrow, Germantown, WI (US); Joseph F. Changle, Carnegie, PA (US); Kenneth N. Skoug, Pittsburgh, PA (US); Roger W. Helms, Beaver Falls, PA (US); Lance Gula, Clinton, PA (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 09/504,602

(22) Filed: Mar. 30, 1998

Related U.S. Application Data

(62) Division of application No. 08/864,104, filed on May 28, 1997, now abandoned.

(51) Int. Cl.[7] ..... H01H 75/00; H01H 77/00; H01H 83/00

(52) U.S. Cl. ..... 335/14; 335/167; 335/172

(58) Field of Search ..... 335/14, 20, 35, 335/167–172

(56) References Cited

U.S. PATENT DOCUMENTS 3,293,577 * 12/1966 Kiesel et al. ..... 335/18
5,093,643 * 3/1992 Altenhof, Jr. et al. ..... 335/20
5,347,248 * 9/1994 Herbert ..... 335/18
5,886,605 * 3/1999 Ulerich et al. ..... 335/172

* cited by examiner

*Primary Examiner*—Lincoln Donovan
*Assistant Examiner*—Tuyen T. Nguyen
(74) *Attorney, Agent, or Firm*—Martin J. Moran

(57) ABSTRACT

A molded case circuit breaker is taught with a housing base and a primary cover disposed on the housing base. The primary cover has a recess therein for an auxiliary module which is disposed in the recess. A secondary cover is disposed on the primary cover for covering the recess when the auxiliary module is disposed therein. A combination manual trip and secondary cover interlock is provided which is accessible from outside of the secondary cover for manually opening separable main contacts or for automatically opening separable main contacts when the secondary cover is removed. There is also provided on the back plane of the housing a single piece DIN rail attachment for securing the back plane to a DIN rail. There is provided an under voltage release mechanism for actuating the circuit breaker to trip on the occurrence of an under voltage condition of predetermined magnitude across the lines served by the circuit interrupter. The under voltage release mechanism has an adjustment spring which is controlled by a nut or thumb screw on a shaft to vary the spring force for calibrating the under voltage release mechanism. There is also provided a self-retaining collar member for the load and line terminals of the circuit interrupter. The collar member comprises a locating protrusion in the bottom thereof which aligns with a hole in the load or line conductors. Side entrapment members which entrap the line or load conductor therebetween and between the bottom of the collar member are also provided.

1 Claim, 28 Drawing Sheets

CIRCUIT INTERRUPTER WITH COVERED ACCESSORY CASE, ADJUSTABLE UNDER VOLTAGE RELAY, SELF-RETAINING COLLAR AND ONE-PIECE RAIL ATTACHMENT

CROSS REFERENCE TO RELATED APPLICATIONS

This is a division of application Ser. No. 08/864,104 filed May 28, 1997 now abandoned. The subject matter for this invention is related to concurrently filed co-pending applications: U.S. patent application Ser. No. 08/864,095 filed May 28, 1997 entitled "Circuit Interrupter With Plasma Arc Acceleration Chamber And Contact Arm Housing"; U.S. patent application Ser. No. 08/864,141 filed May 28, 1997, entitled "Circuit Breaker With Welded Contact Inter-lock, Gas Sealing Cam Rider And Double Rate Spring" and U.S. patent application Ser. No. 08/864,100 filed May 27, 1997 entitled "Combined Wire Lead And Interphase Barrier For Power Switches", U.S. Pat. No. 5,875,885 Mar. 2, 1999.

BACKGROUND OF THE INVENTION

1. Field of the Invention

The subject matter of this invention is related to circuit interrupters generally and more particularly to covered accessory cases therefore, as well as adjustable under voltage relays, wire retainer collars and one-piece rail attachments.

2. Description of the Prior Art

The present invention provides an improvement over U.S. Pat. No. 4,503,408 issued Mar. 5, 1985 to Mrenna et al entitled "Molded Case Circuit Breaker Apparatus Having Trip Bar With Flexible Armor Interconnection" which is assigned at this time to the assignee of the present application and which is incorporated by reference herein. Accessories for molded case circuit breakers have been known for a long time. Generally in the past the accessories have been mounted externally of the internal portion of the circuit breaker. Molded case circuit breakers are well known in the art. An example of such an accessory is found in U.S. Pat. No. 4,595,812 issued Jun. 17, 1986 to Tamaru et al entitled "Circuit Interrupter With Detachable Optional Accessories". In some cases the accessories are mounted within the internal portion of the circuit interrupter and are protected from interference or dangerous contact by an accessory cover. Examples of such covers are shown in U.S. Pat. No. 4,754,247 issued Jun. 28, 1988 to P. A. Raymont et al entitled "Molded Case Circuit Breaker Accessory Enclosure"; U.S. Pat. No. 4,757,294 issued Jul. 12, 1988 to Todarol entitled "Combined Trip Unit and Accessory Module for Electronic Trip Circuit Breakers" and U.S. Pat. 4,788,621 issued Nov. 29, 1988 to Russell et al entitled "Molded Case Circuit Breaker Multiple Accessory Unit". In all of these examples, the covers can not be removed or opened when the circuit breaker contacts are in the closed position, this provides a safety feature. It would be advantageous, however, if means were found to automatically trip a circuit breaker if the cover is opened and where the same device could be used manually simply to trip the circuit breaker upon desire.

In Europe, molded case circuit breakers are disposed on mounting apparatus called DIN rails rather than in typical load centers as is the common practice in the United States. Therefore, circuit breakers manufactured for use in Europe must be adapted to be interconnected with the DIN rails. An example of such a separate adapter mechanism may be found in U.S. Pat. 5,192,227 issued Mar. 9, 1993 to Bales entitled "DIN Rail Mounting Bracket". Usually the aforementioned DIN rail attachments come in multiple pieces which are assembled onto the back of the circuit breaker for snapping onto the DIN rail at a later time. It would be advantageous if a single DIN rail adapter connection device could be found which was part of the circuit breaker casing.

Many molded case circuit breakers have under voltage trip release mechanisms for causing the circuit breaker to trip open when the voltage on the lines thereof falls below a predetermined limit. The under voltage release mechanism must be adjustable to accommodate many different ranges of voltages and to account for small manufacturing errors when adapted for the use with a single voltage. It would be advantageous if an under voltage release spring adjustment could be found which would simplify the above indicated problem.

Molded case circuit breakers have load and line terminals for interconnection with circuits to be protected or from which power is derived respectively. In order to interconnect the aforementioned terminals with the circuits in question, a collar is provided on the terminal for the interconnection. Such a collar is shown in U.S. Pat. No. 5,206,789 issued Apr. 27, 1993 to Barbry entitled "Terminal Assembly For A Circuit Breaker And Similar Apparatus" assigned on the record to the assignee of the present application. The latter patent is incorporated herein by reference. In order to secure the interconnection between the load conductor for example and the wiring, the wiring and load conductor must be joined by way of the collar. This is a delicate operation requiring the collar to be held precisely in place as the joint is completed. It would be advantageous if a collar arrangement could be found which was self-retaining, that is which was disposed upon the line or load conductor of the circuit breaker in such a manner as to not require separate activity during the connecting operation.

SUMMARY OF THE INVENTION

In accordance with the invention, an electrical circuit interrupter is taught which includes a housing base and a primary cover disposed thereon where the primary cover has a recess therein for an auxiliary module. A secondary cover is disposed on the primary cover for covering the recess. An operating mechanism containing first and second separable main contacts is disposed within the housing. A combination manual trip and secondary cover interlock which is accessible from outside of the secondary cover is provided for either manually opening the separable main contacts or for automatically opening the separable main contacts when the cover is opened.

The circuit interrupter has a trip means interconnected for opening the separable main contacts upon actuation. An under voltage release mechanism is disposed within a housing in a disposition of structural cooperation with the operating mechanism for actuating the trip device on the occurrence of an under voltage of predetermined magnitude on a circuit which is interconnected with the separable main contacts. The under voltage release mechanism comprises a spring loaded plunger which is held in a first disposition when the voltage is greater than the predetermined magnitude but which actuates under the influence of the spring when the voltage is substantially equal to or less than that predetermined magnitude. The adjustment of the spring is controlled by a threaded nut or thumb wheel on a shaft which abuts against one end of the spring for changing the spring force to vary the predetermined magnitude.

A collar for an electrical circuit interrupter is taught which is utilized for interconnecting a conductor of the circuit interrupter with an external electrical conductor. The collar includes a bottom portion and side portions forming an enclosure. Transverse trap means are disposed internally of the enclosure on the side portions for capturing the rectangular cross-sectional conductor therebetween and the bottom portion. The bottom portion has a locating protrusion thereon which aligns with a hole in the conductor of the circuit breaker for fixing the disposition of the collar on that conductor.

DESCRIPTION OF THE PREFERRED EMBODIMENT

Figure 1:
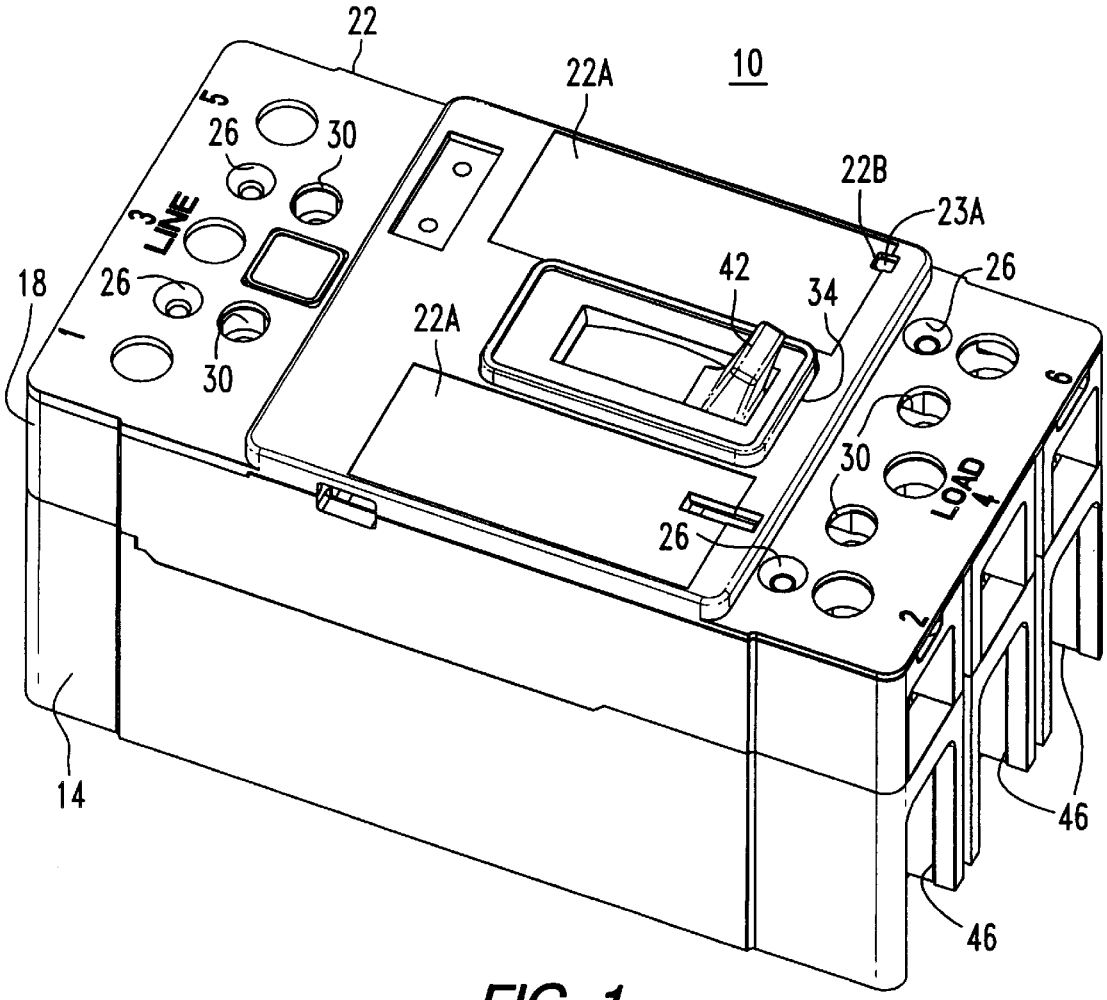
FIG. 1 shows an orthogonal view of a molded case circuit breaker embodying the teachings of the present invention.
Figure 2:
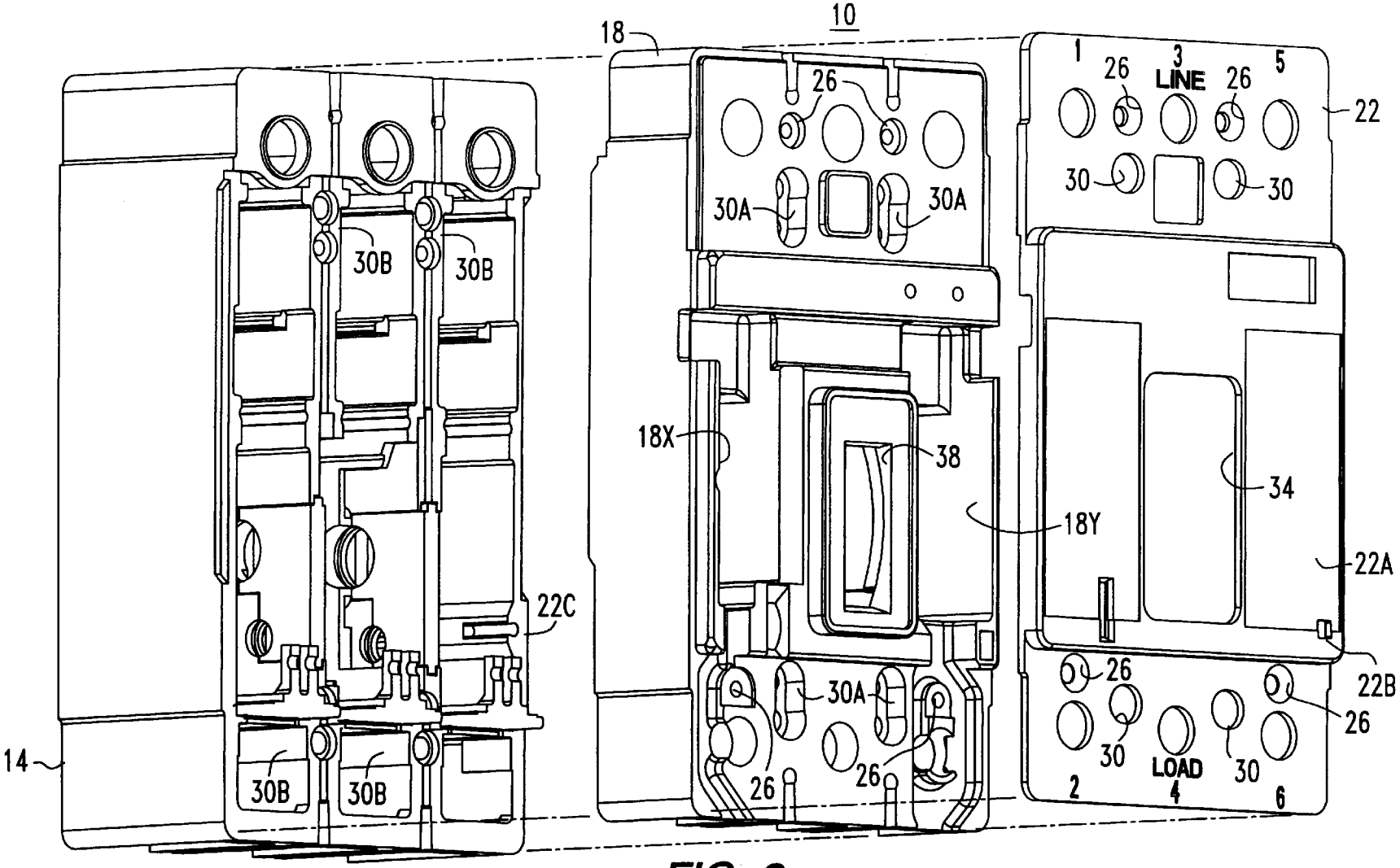
FIG. 2 shows an exploded view of the housing, primary cover and secondary cover of the circuit breaker of FIG. 1.

Referring now to the drawings and FIGS. 1 and 2 in particular, there is shown a molded case circuit breaker 10. Molded case circuit breaker 10 includes a lower base portion 14 mechanically interconnected with a primary cover 18. Disposed on top of the primary cover 18 is an auxiliary or secondary cover 22. The secondary cover 22 may include slightly depressed regions 22A therein into which nameplates for the circuit breaker 10 may be disposed. There is also provided on the right an opening 22B for a combination push-to-trip interlock member as will be described hereinafter. The secondary cover 22 may be removed from the circuit breaker rendering some internal portions of the circuit breaker available for maintenance and the like without disassembling the entire circuit breaker. In particular, the secondary cover 22 may shield auxiliary devices such as under-voltage relays, bell alarms and auxiliary switches, for example, which will be described hereinafter. Holes or openings 26 are provided in the secondary cover 22 for accepting screws for fastening the auxiliary or secondary cover 22 to the primary cover 18. Additional holes 30 which feed through the auxiliary cover 22, the primary cover 18 and the base 14 are provided for bolting the entire circuit breaker assembly onto a wall, into a DIN rail back panel or into a load center or the like. The auxiliary cover 22 includes an auxiliary cover handle opening 34. The primary or main cover 18 includes a primary cover handle opening 38. There is provided a handle 42 which protrudes through the aforementioned auxiliary cover handle opening 34 and the primary cover handle opening 38. The handle 42 is utilized in the normal manner to open and close the contacts of the circuit breaker manually and to reset the circuit breaker when it has been tripped. It may also be provided as an indication of the status of the circuit breaker, that is whether the circuit breaker is ON, OFF or TRIPPED. There is also shown in base 14 an elongated circular groove 22C for capturing the combination push-to-trip interlock member in a manner which will be described more fully hereinafter. Protruding upwardly through the rectangular opening 22B is a top portion 23A of the aforementioned combination push-to-trip interlock member the details of which will be more fully explained hereinafter. There are also shown three load conductor openings 46 which shield and protect load terminals 50 (not shown). The circuit breaker depicted is a three-phase circuit breaker. However, the invention is not limited to three-phase operation. Not depicted in FIGS. 1 and 2 are the LINE terminals which will be described hereinafter.

Figure 2A:
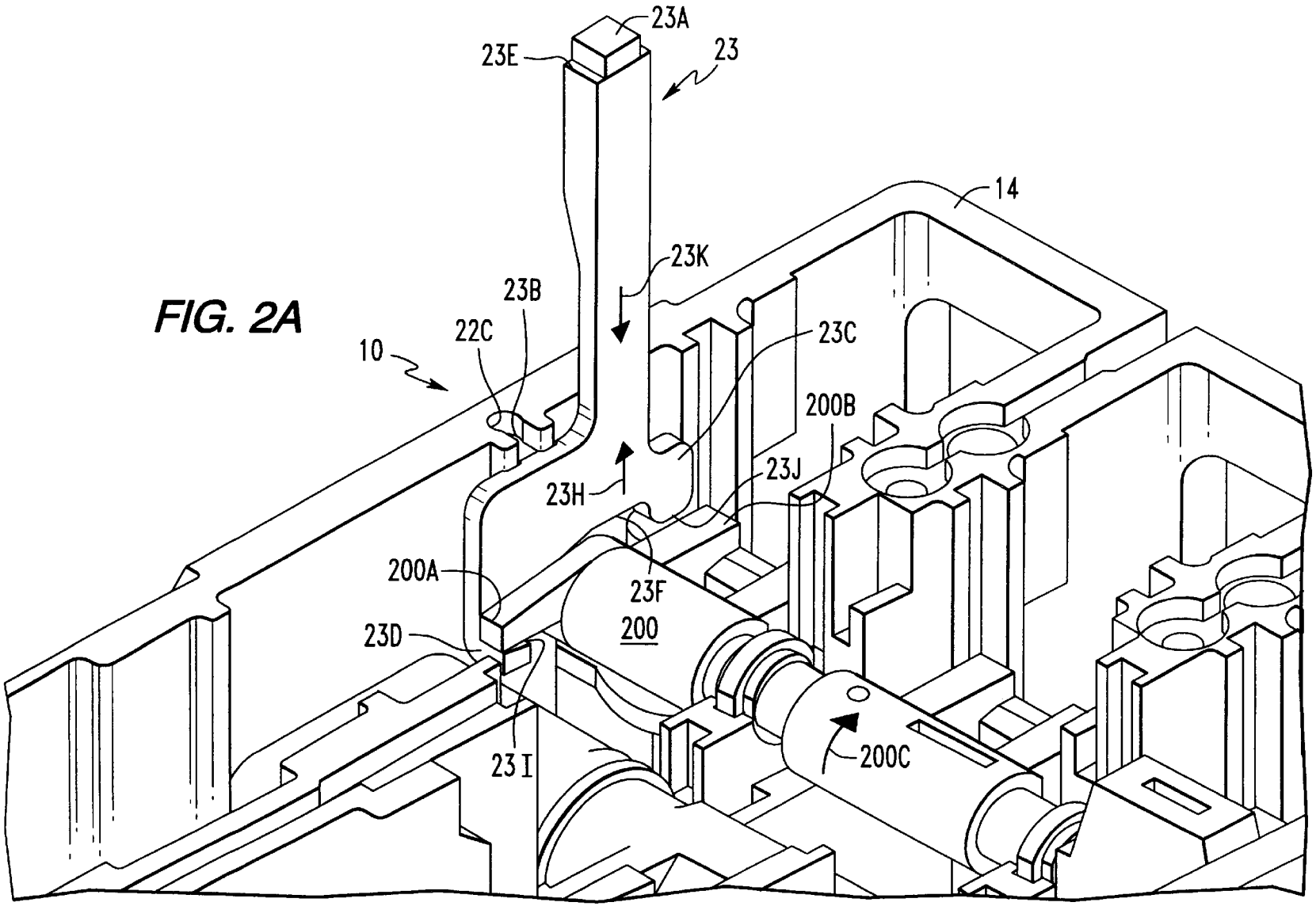
FIG. 2A shows an orthogonal view partially broken away of the combination push-to-trip and auxiliary cover interlock member.

Referring now to FIG. 2A there is shown a broken away orthogonal view of the circuit breaker 10 in the region of the base 14 with the combination push-to-trip and secondary cover interlock member 23 in place. In particular, member 23 includes a rectangular push-button top portion 23A which was described with respect to FIG. 2. There is also provided an extended circular guide member 23B which is connected in interlocking disposition with the aforementioned groove 22C such that member 23 may move upwardly or downwardly in the directions 23H and 23K, but may not rotate or move otherwise. On a lower part of the member 23 is a first push-to-trip tab portion 23C and oppositely dispose thereof, on the other side of member 23A is an angularly offset pull-to-trip tab member 23D. Provided rear the top of the member 23 is a set of shoulders 23E which separate the main body of the combination member 23 from its push-to-trip region 23A. The shoulders 23E abut upwardly against the bottom surface of the secondary cover 22 to prevent further linear motion in the upward direction. The middle bottom portion of the member 23B is designated 23F and it provides a seat for a compression spring (not shown) which biases the member 23 in the direction 23H. A rotatable trip shaft 200 is shown which will be described in further detail hereinafter. For the purposes of this portion of the invention it is sufficient to say that the trip shaft 200 is biased rotationally by a torsion spring in the rotational direction opposite to that shown at 200C. Rotation of the member 200 in the direction 200C will cause a tripping of the circuit breaker in a manner to be described hereinafter. The combination member 23 provides the aforementioned rotation 200C in either of two manners. If the push-to-trip surface 23A is actuated downwardly in the direction, 23K push-to-trip tab member 23J will impinge upon tab member 200B which is rigidly attached to the rotating shaft 200 in such a member as to rotate the shaft 200 in the direction 200C and cause a tripping action of the circuit breaker. On the other hand, if the secondary cover 22 is remove the shoulder 23E has nothing to abut upwards against under the influence of the compression spring acting on portion 23F which causes the member 23 to be forced upwardly in the direction 23H by the action of the compression spring thus causing the secondary cover interlock tab 23D to strike upwardly against tab member 200A on the shaft 200 thus forcing the shaft 200 to rotate in the direction 200C thus causing the circuit breaker to trip. Consequently it can be seen that the same member 23 may be utilized to trip the circuit breaker by interaction thereof with the shaft 200 either by downward motion in the direction 23K when a push-to-trip actuation is required or by upward motion in the direction 23H if the secondary cover is removed.

Figure 3:
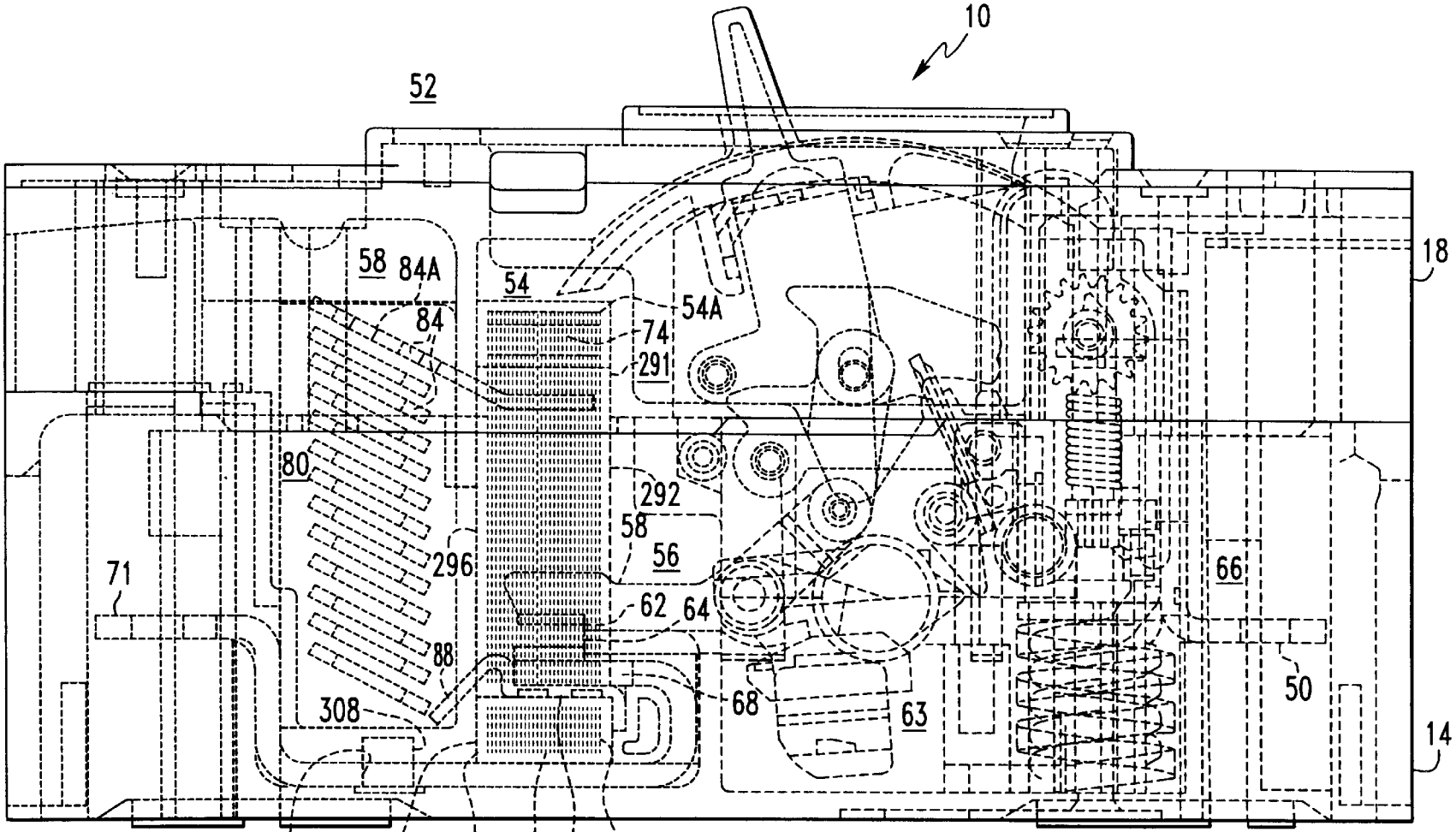
FIG. 3 shows a side elevation of an internal portion of the circuit breaker of FIG. 1.

Referring now to FIG. 3, a longitudinal section of a side elevation, partially broken away and partially in phantom of the circuit breaker 10 is depicted. In this depiction, certain key features of the circuit breaker are shown. It is to be understood that many of these features will also be described in greater detail hereinafter. There is shown a plasma arc acceleration chamber comprising a slot motor assembly 54 and an arc extinguisher assembly 58. There is also shown a contact assembly 56 comprising a movable contact arm 58 supporting thereon a movable contact 62 and a stationary contact arm 68 supporting thereon a stationary contact 64. An operating mechanism 63 is also depicted. The operating mechanism 63 will be described in further detail hereinafter. The operating mechanism 63 is similar to and operates similarly to that shown and described in U.S. Pat. No. 4,503,408 issued Mar. 5, 1985, to Mrenna et al, which patent is herein incorporated by reference. There is also shown a trip mechanism 67 which in this non-limiting embodiment of the invention is an electromagnetic trip mechanism. It is to be understood that in other embodiments of the invention a thermal trip mechanism may be utilized or a combination of a thermal trip mechanism and an electro-magnetic trip mechanism may be utilized.

The slot motor assembly 54 includes a separate upper slot motor assembly 54A and a separate lower slot motor assembly 54B. The upper slot motor assembly 54A includes stacked side-by-side U-shaped upper slot motor assembly plates 74 which are composed of magnetic material. In a like manner lower slot motor assembly plates 78 are disposed in the lower slot motor assembly 54B. Lower assembly plates 78 are also composed of magnetic material. The combination of the upper slot motor assembly plates and the lower slot motor assembly plates 74 and 78 respectively, form an essentially closed electromagnetic path which provides the slot motor function which is shown and described in U.S. Pat. No. 3,815,059 issued Jun. 4, 1974 to Spoelman and entitled "Circuit Interrupter Comprising Electro-Magnetic Opening Means."

The arc chute assembly 58 includes an arc chute 80 having spaced apart generally parallel angularly off-set arc chute plates 84 and an upper arc runner 84A. There is also provided a lower runner 88 which is not part of the arc chute 80. There is also provided a line terminal 71.

Figure 4:
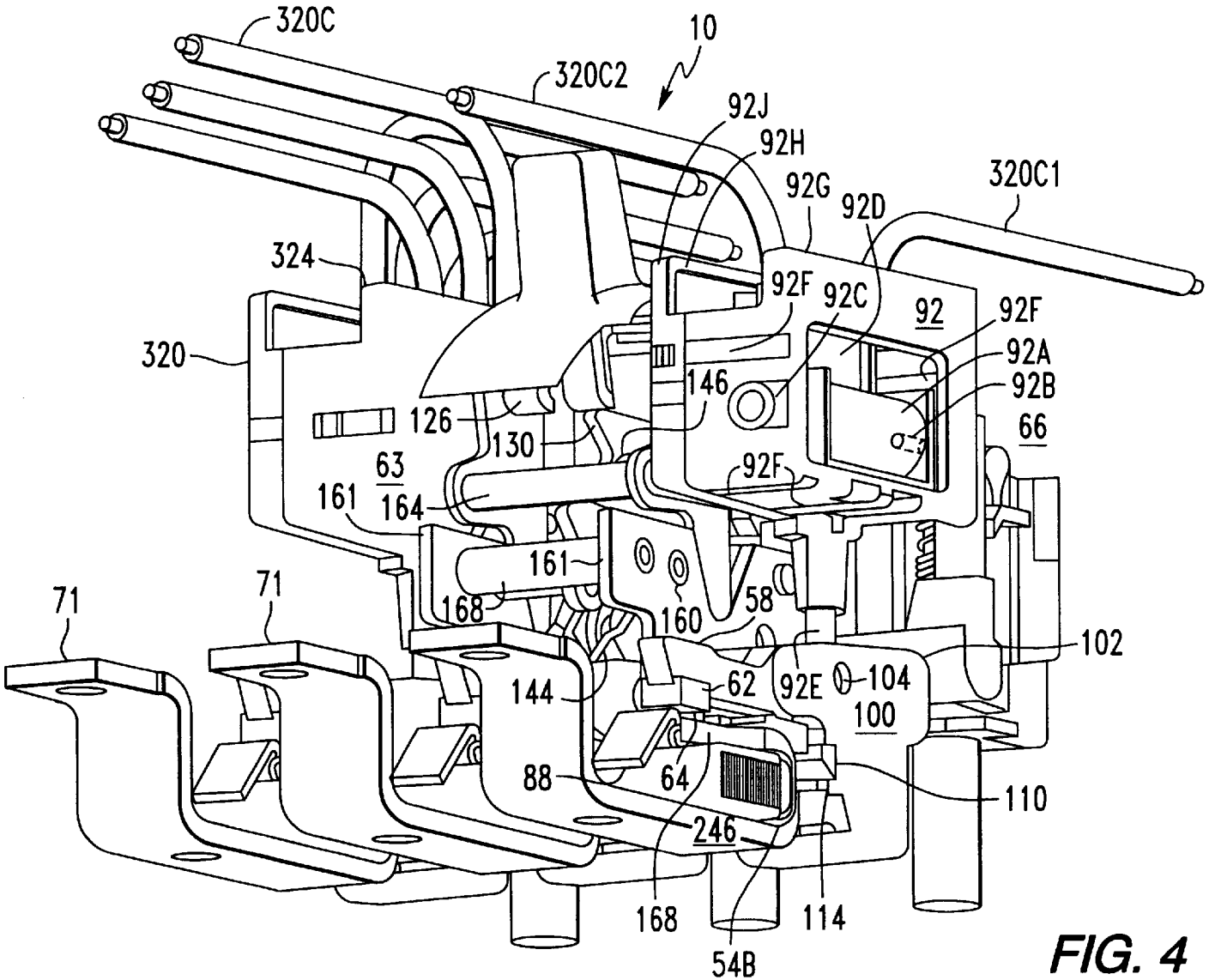
FIG. 4 shows an orthogonal view of the operating mechanism, movable contact arrangement, shunt trip device and contact support member of the circuit breaker of FIG. 1.
Figure 13:
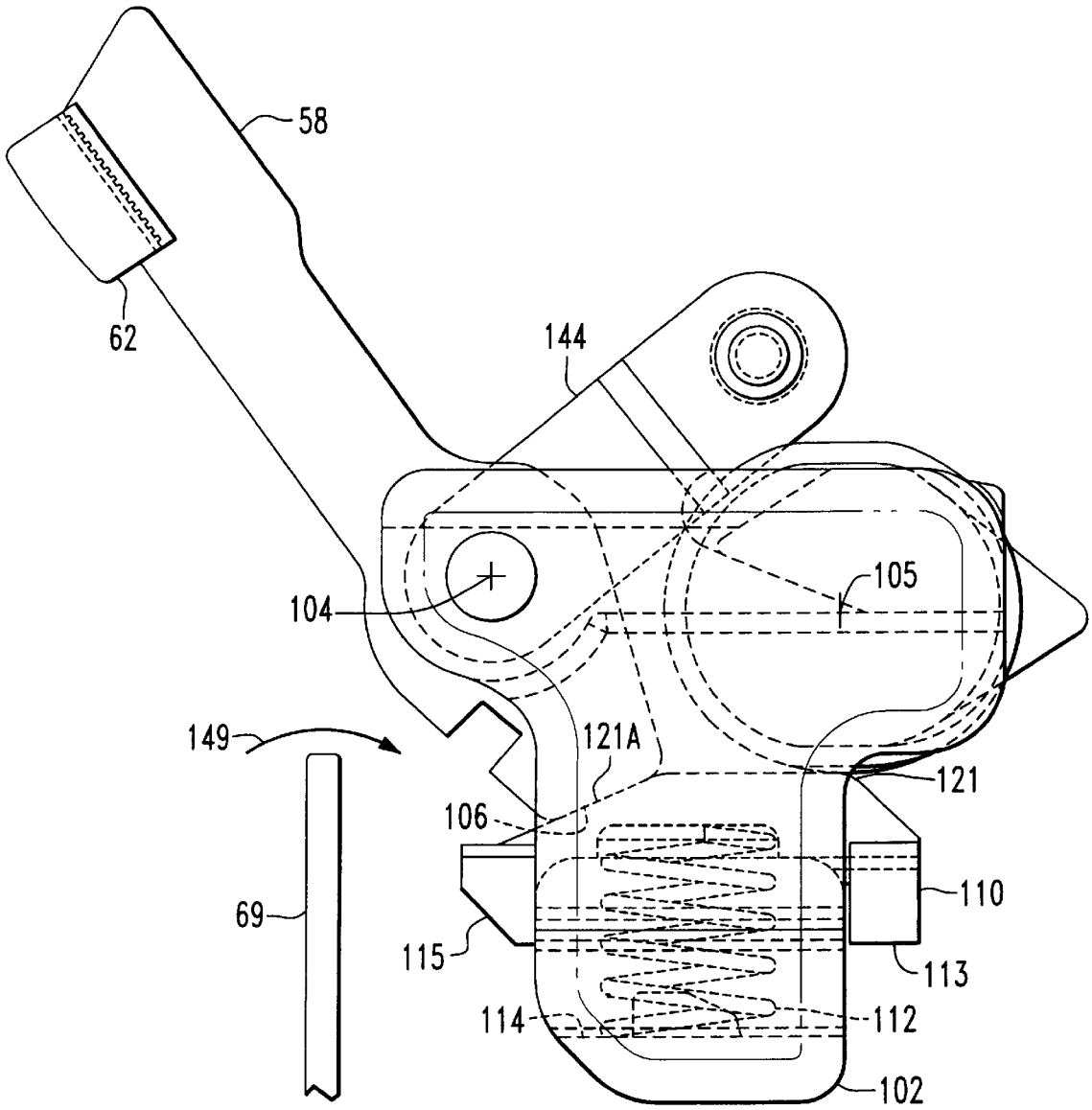
FIG. 13 shows a side elevation partially broken away of the crossbar and cam rider of FIGS. 11 and 12 operating in conjunction with the movable contact as disposed in the blown-open state.

Referring to FIG. 4 and FIG. 13, an orthogonal view of an internal portion of the circuit breaker 10 is shown. In particular, there is shown a crossbar assembly 100 which traverses the width of the circuit breaker and which is rotatably disposed on an internal portion of the base 14 (not shown). Movement of a lower toggle link 144, in a manner which will be described hereinafter, causes the crossbar 100 and the associated movable contact arms 58 to rotate into or out of a disposition which places movable contacts 62 into or out of a disposition of electrical continuity with fixed contacts 64. Each movable contact arm 58 is rotatably disposed upon a pivot pin 104 which is disposed in the movable contact cam housing 102. There is one movable contact cam housing 102 for each movable contact arm 58. Disposed in the movable contact cam housing is a cam follower 110 which is spring loaded by way of a spring 112 (see FIG. 13) in the upward direction against the movable cam 110 (see FIG. 13). During assembly, the cam follower 110 is inserted into the cam follower opening 114 in the housing 102 in a longitudinal direction and then raised upwardly against the cam 110. The spring 112 is interposed between the upside of the bottom of the housing 102 and the bottom of the cam follower 110 thus urging the cam follower 110 against the bottom surface or camming surface 106 of the contact arm 58. It is to be noted with respect to the crossbar assembly 100 that the movable contact arm 58 is free to rotate within limits independently of the rotation of the crossbar assembly 100. In certain dynamic, electromagnetic situations, the movable contact arm 58 can rotate upwardly about the movable contact pivot pin 104 under the influence of high magnetic forces whereupon it is latched in that disposition by the action of the rear most surface or latching surface of the movable contact arm 58 and the cam follower 110. Under normal circumstances however, the movable contact arm 58 rotates in unison with the rotation of the housing 102 as housing 102 is rotated clockwise or counter-clockwise by the action of the lower link pin 144. Also depicted in FIG. 4 is a portion of a self-contained auxiliary switch and alarm lock 320 which will be described in greater detail with reference to FIG. 5.

Figure 6:
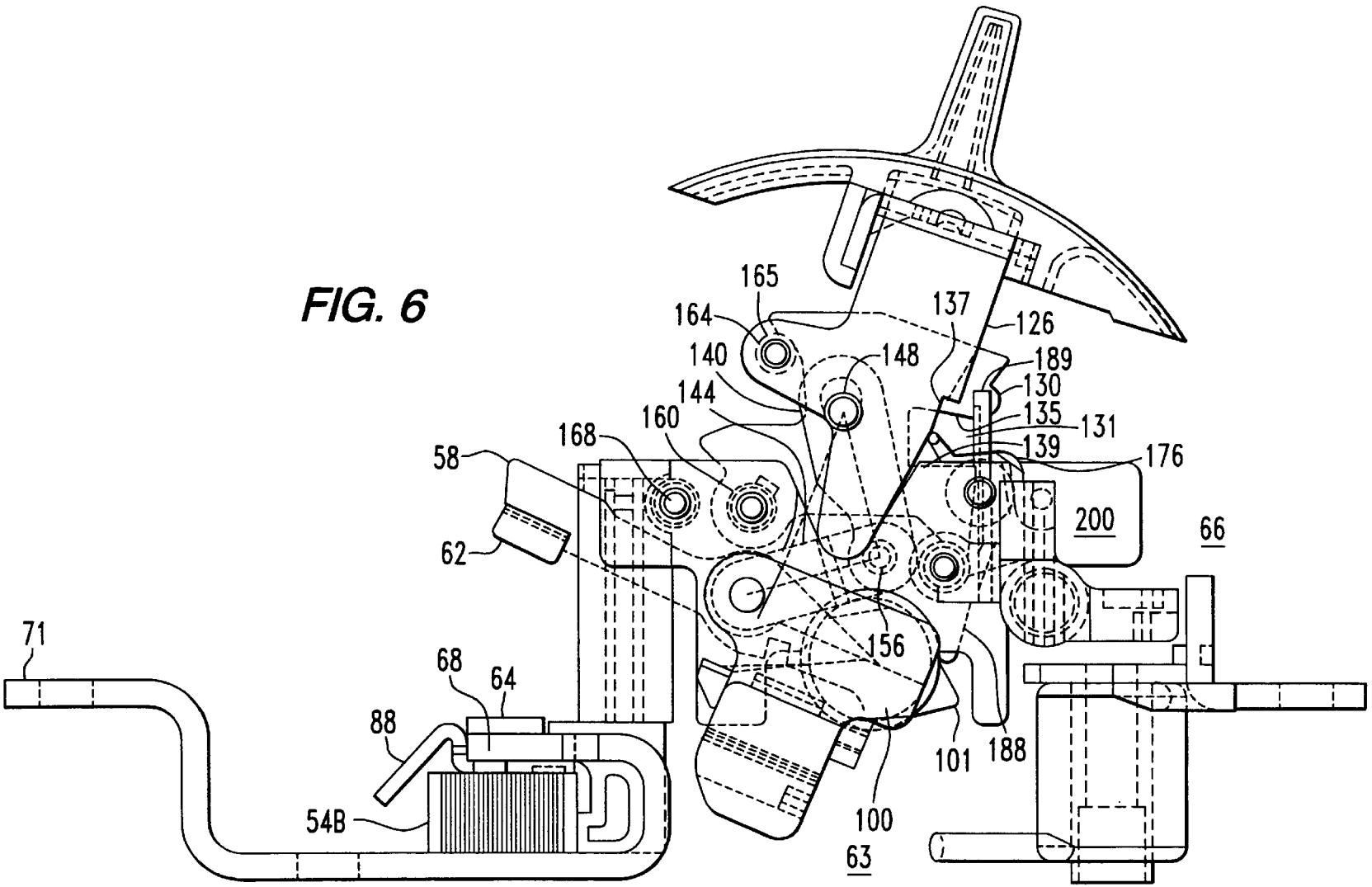
FIG. 6 shows a side elevation partially broken away of the operating mechanism of the circuit breaker of FIG. 1 with the contacts and handle in the OPEN state.

Continuing to refer to FIG. 4 and also referring to FIG. 6, the operating mechanism 63 is depicted and described. The operating mechanism 63 comprises a handle assembly 126, a cradle assembly 130, an upper toggle link 140, an interlinked lower toggle link 144, and an upper toggle link pivot pin 148 which interlinks the upper toggle link 140 with the cradle assembly 130. The lower toggle link 144 is pivotally interconnected with the upper toggle link 140 by way of the intermediate toggle link pivot pin 156. There is provided a cradle assembly pin 160 which is laterally disposed between parallel, spaced apart operating mechanism support members 161. Cradle assembly 130 is free to rotate within limits about cradle assembly pivot pin 160. There is provided a handle assembly roller 164 which is disposed in and supported by the handle assembly 126 in such a manner as to make mechanical contact with a portion of the cradle assembly 130 during certain operations of the circuit breakers as will be described hereinafter. There is also provided a main stop bar 168 which is also laterally disposed between the operating support members 161. Stop bar 168 abuts and stops or prevents further clockwise movement of the movable contact arm 58 during a circuit breaker opening operation.

Continuing to refer to FIG. 4 and referring once again to FIG. 3, the line terminal 71 and associated lower slot motor assembly and fixed contact support member 246 is shown. The fixed contact arm 68, the fixed contact 64, the arc runner 88 and the lower slot motor assembly 54B all comprise portions of the lower slot motor assembly and fixed contact support member 246.

Figure 19A:
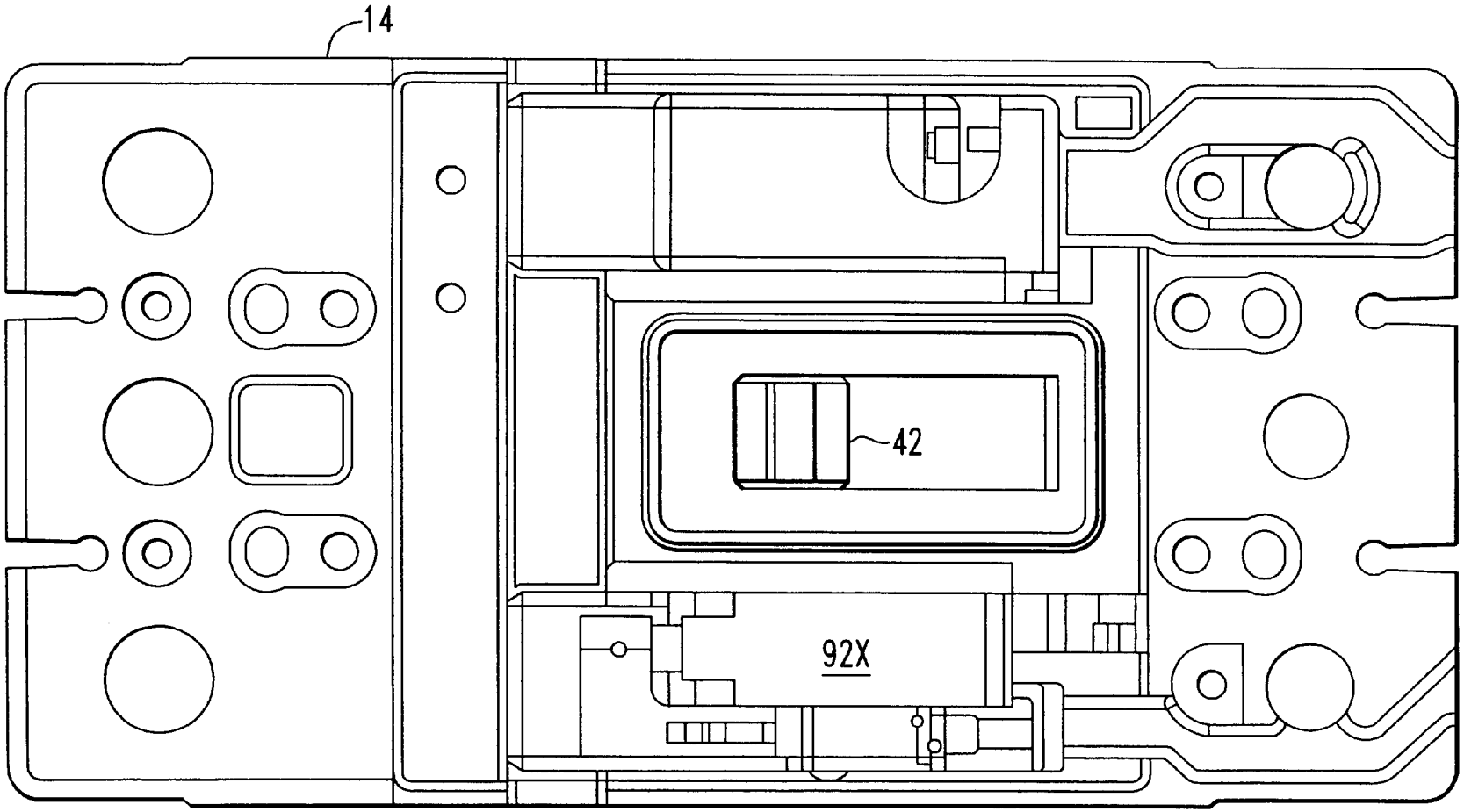
FIG. 19A shows a front elevation of the circuit interrupter of FIG. 1 depicting the under voltage relay arrangement.

Continuing to refer to FIG. 4 there is also depicted a portion of the trip mechanism 66 and a shunt trip device 92. The shunt trip 92 comprises: a shunt trip coil 92A which is normally non-energized, a spring loaded plunger 92B which is spring-loaded to the off or left disposition by the spring 92C in a normal condition, a spring-loaded plunger 92E which is spring-loaded towards the crossbar arrangement 100 and a microswitch 92D. The microswitch 92D may be interconnected to a control facility by way of electrical lines 320C1 and 320C2. If a control signal is provided on the lines 320C1 and 320C2, the coil 92A is energized thus causing the plunger 92B to move to the right against the force of the spring 92C to cause the trip mechanism 66 to trip in a manner to be described hereinafter. Once a tripping action has occurred, the crossbar arrangement 100 rotates upwardly or in the clockwise direction to the right thus causing the spring loaded plunger 92E to move upwardly thus opening the contacts of the switch 92D to prevent energy from being supplied to the coil which may have a tendency to burn it out. After the signal has been removed from the lines 320C1 and 320C2, the spring 92C causes the plunger 92B to move to the left as shown in FIG. 4 for further action at a later time. The case for the shunt trip 92 is of the molded variety. It can be dropped into the previously described opening 18X to thus be covered by the secondary cover 22 in a manner described previously. The drop-in case for the shunt trip 92 comprises two snap together sides 92G and 92J which may be joined together by way of flexible snap in hook arrangements 92F in case portion 92G which in turn interconnects within opening 92H in case portion 92J. In another embodiment of the invention as will be describe hereinafter, the shunt trip arrangement 92 may be replaced by an under voltage module which will be described in greater detail with respect to FIGS. 19A, B and C.

Figure 5:
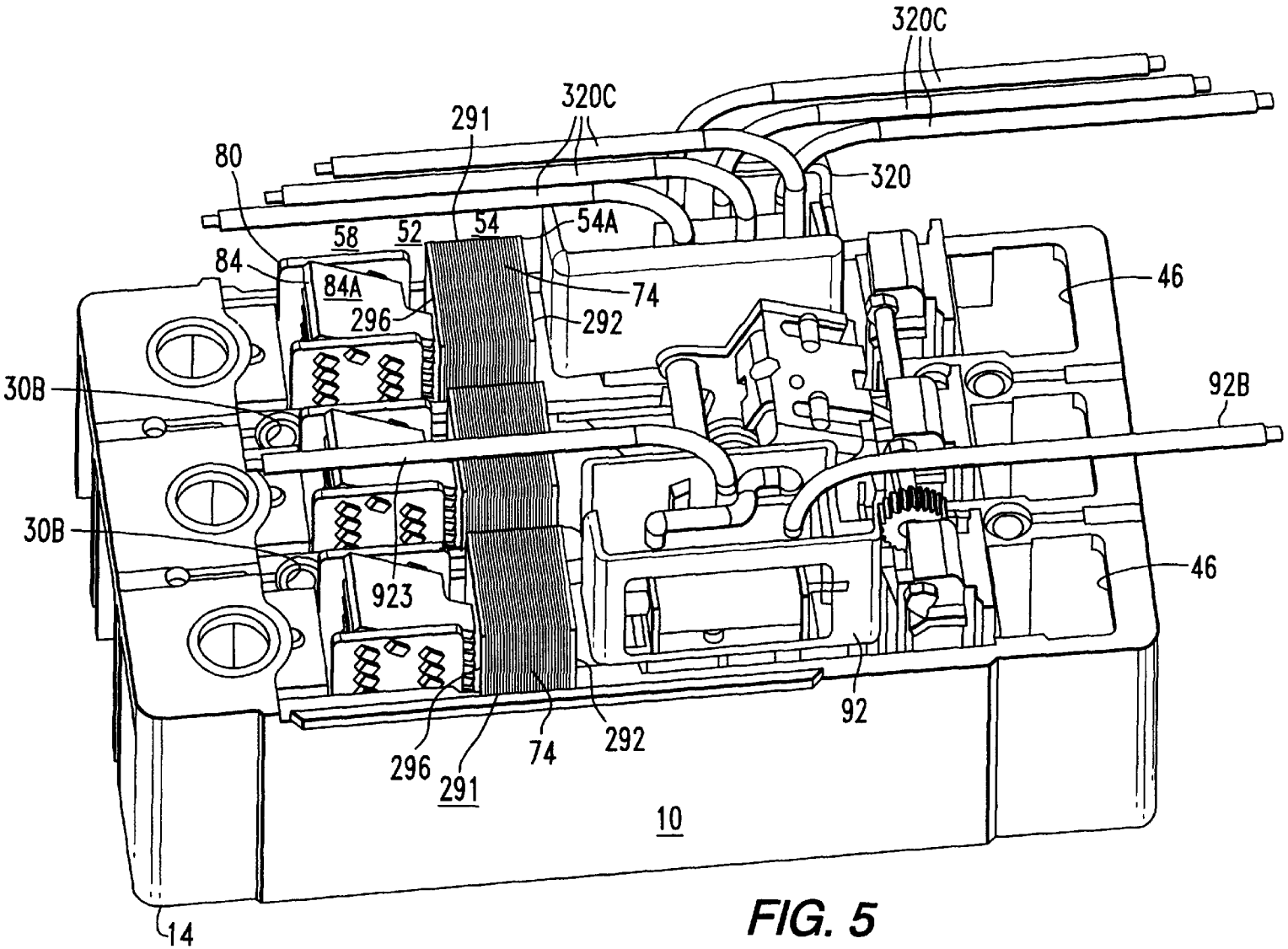
FIG. 5 shows an orthogonal view of a portion of the circuit interrupter shown in FIG. 1 in which the primary cover and secondary cover have been removed.

Referring now to FIG. 5 and FIG. 3 an orthogonal view of the lower base 14 with the upper cover 18 (FIG. 5) removed and some of the internal portions of the circuit breaker apparatus 10 disposed in place is shown. In particular, in FIG. 5 the under voltage relay 92 and shunt trip device are shown disposed in place having part of their collective protective cover broken away. Also shown is the self-contained auxiliary switch 320, alarm 324 (see FIG. 18) and associated wiring 320C. The load conductor openings 46 are shown on the right and the panel mounting holes 30B in the base are shown to the left. Also shown is the plasma arc acceleration chamber 52 comprising the slot motor assembly 54 on the right and the arc extinguisher 58 on the left. The upper slot motor assembly 54A includes stacked or layered, upper slot motor assembly plates 74 sandwiched between a front plate 292 and rear plate 296 of the upper slot motor assembly housing 291 which in turn comprises a portion of the upper slot motor assembly 54A. Shown to the left of the slot motor assembly 54 is the arc chute 80 assembly or arc extinguisher 58. The arc chute 80 comprises spaced, generally parallel, angularly slanted arc chute plates 84 of which the upper arc runner 84A is most prominently shown.

Referring once again to FIG. 6, an elevation of that part of the circuit breaker 10 particularly associated with the operating mechanism 63 is depicted. The contacts 62 and 64 are shown in the disconnected or open disposition of the circuit breaker operating mechanism 63. Stop bar 168 is shown in a disposition sufficient to prevent movable contact arm 58 from rotating significantly further upwardly in a clockwise direction. Cradle assembly pivot pin 160 supports cradle assembly 130 in such a manner that handle assembly roller 164 abuts against a back portion 165 of the cradle assembly 130. In certain operations of the operating mechanism 63, roller pin 164 rolls against arcuate portions of region 165 for the purpose of moving or rotating the cradle assembly 130 about cradle assembly pivot pin 160 in a clockwise direction for the purpose of resetting the circuit breaker in a manner which will be described hereinafter. In the disposition shown in FIG. 6, intermediate latch 176 is shown in its latched position abutting hard against the lower portion 139 of the latch region 131 of the cradle assembly latch cutout 135. A pair of side-by-side aligned compression springs (not shown) such is shown in U.S. Pat. No. 4,503,408 is disposed in the operating mechanism 63 between the top portion of the handle assembly 126 and the knee or intermediate toggle link pivot point 156. The tension in the aforementioned springs has a tendency to load portion 139 against the intermediate latch 176. Latch 176 is prevented from unlatching the cradle assembly 130 because the other end thereof is fixed in place by the trip bar assembly 200 which is spring biased in the counter-clockwise direction against the intermediate latch 176. This is the standard latch arrangement found in all dispositions of the circuit breaker except the unlatched disposition which will be described hereinafter.

In the disposition shown in FIG. 6, positive off-link 188 which is biased against rotation in the clockwise direction abuts against the circular portion of the crossbar 100 in such a manner that the fixedly attached positive off-link upper portion 189 is in a disposition of clearance away from the handle assembly cutout 137 so that movement in the clockwise rotational direction of the handle assembly 126 will be in such a manner that the cutout 137 misses or clears the aforementioned positive off-link upper portion 189.

Figure 10:
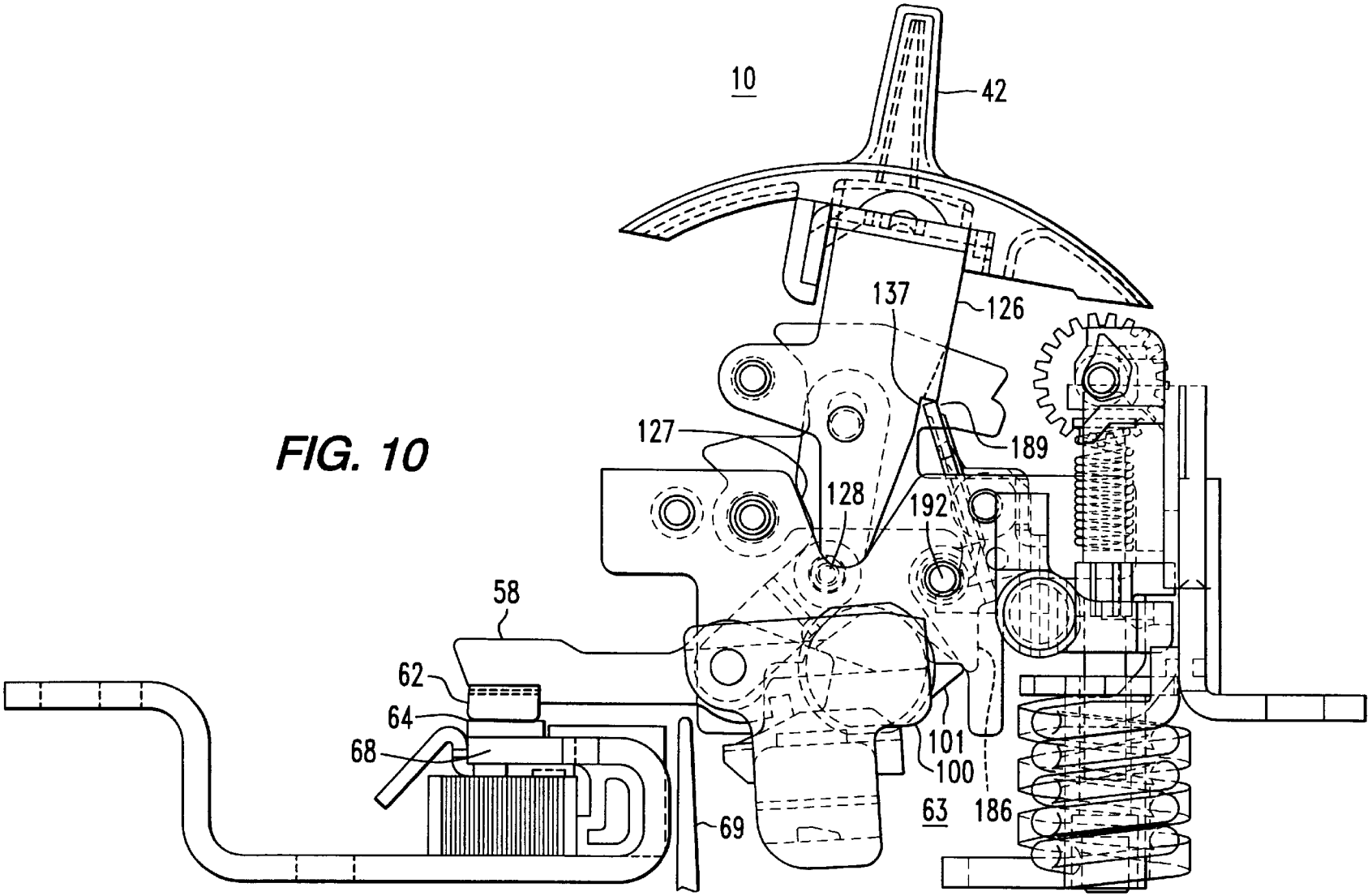
FIG. 10 shows a side elevation partially broken away of the rotating crossbar, handle mechanism and anti-weld interlock of the circuit interrupter of FIG. 1.

If, on the other hand, an operation tending to open the circuit breaker contacts resulting in a movement of the handle mechanism 42 in the clockwise direction to the right as will be shown and described in greater detail with respect to FIG. 10, will not cause the contacts 62 and 64 to separate such as when they are in a welded-closed disposition, the crossbar positive off protrusion 101 will force the positive off-link 192 to rotate in the counter-clockwise direction to the left. This causes handle assembly cutout 137 to abut against the positive off-link upper portion 189 thus preventing further movement of the handle in the clockwise direction to the right. This clearly indicates that the contacts have not opened even though an opening operation has been attempted.

Figure 7:
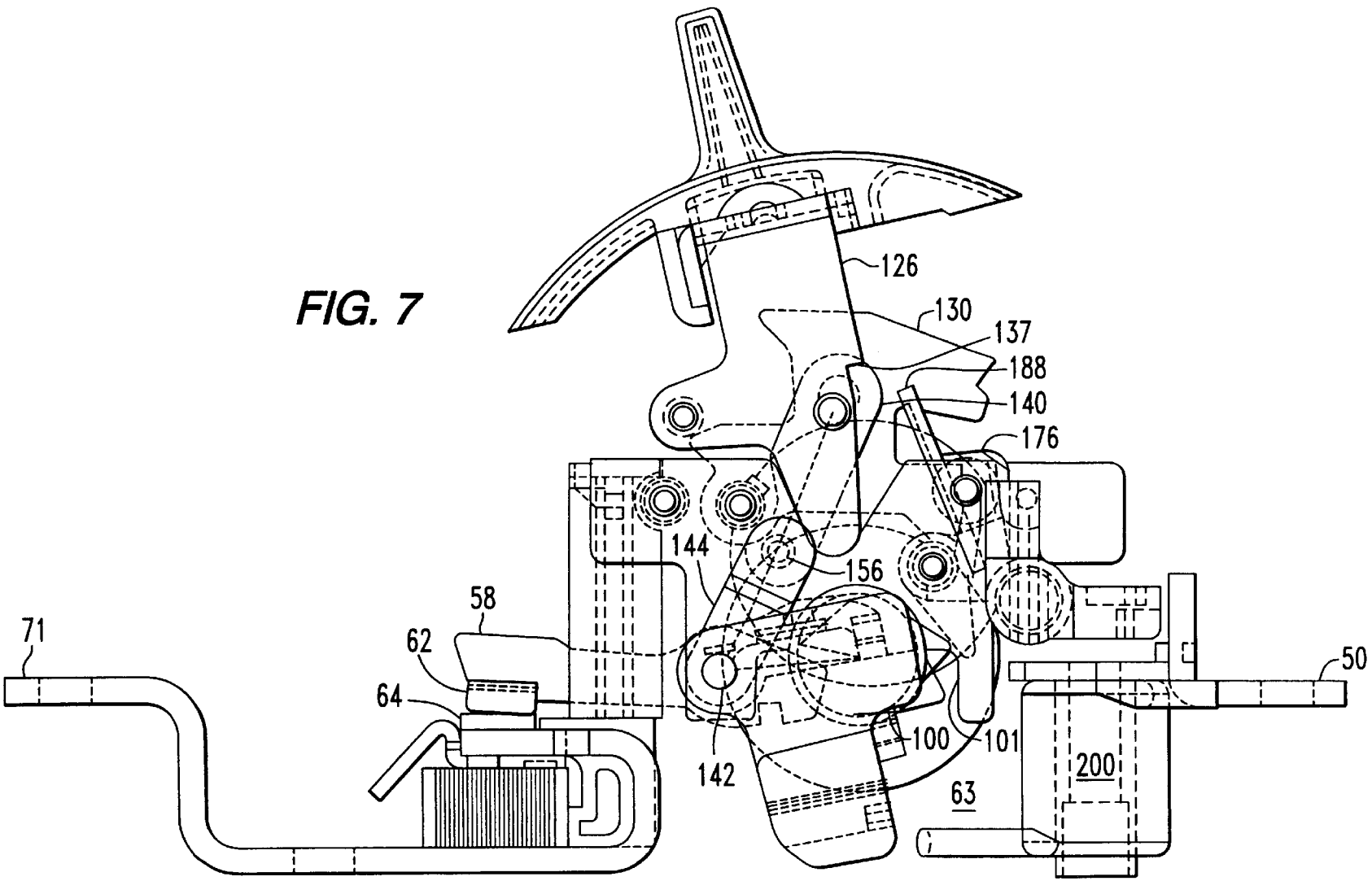
FIG. 7 shows an arrangement similar to FIG. 6 but with the contacts and handle in the ON state.

Referring now to FIG. 7, the arrangement of the operating mechanism 63 is shown for the circuit breaker in the CLOSED disposition. In this disposition an electrical current may flow from load terminal 50 to line terminal 71 through the closed contacts 62 and 64 of the circuit breaker. The handle 42 has been rotated in a counter-clockwise direction to the left thus causing fixedly attached handle assembly 126 to rotate to the left or in a counter-clockwise direction thus causing the intermediate toggle link pivot point 156 to be influenced by the tension springs attached thereto (not shown) and to the top of the handle mechanism 126 to cause the upper and lower toggle links 140 and 144 respectively to assume the position shown in FIG. 7. The assumption of the aforementioned position causes the pivotal interconnection with the crossbar 100 at pivot point 142 to rotate the crossbar 100 in the counterclockwise direction in such a manner as to cause arm 58 to force contact 62 into a pressurized abutted disposition with contact 64. In comparing the arrangement of the elements of the operating mechanism 63 between FIGS. 6 and 7, the following elements remain unchanged in disposition: The cradle assembly 130 remains latched by the intermediate latch 176 as influenced by the trip assembly 200. In addition since the movable contact arm 58 has been rotated into a disposition to close or abut the contacts 62 and 64 the cross bar positive-off protrusion 101 has made contact with the positive-off link 188 rotating it against its bias torsion spring in a counter-clockwise direction for being in a disposition to intercept the handle assembly cutout 137 in the event there occurs an operation tending to move the handle 42 and the associated handle assembly 26 to the right in a clockwise direction in an opening or tripping operation while the contacts 62, 64 remained closed. The following elements have attained a different orientation in FIG. 7 relative to FIG. 6: The handle assembly 126 has been rotated counter-clockwise to the left thus causing upper toggle link 140 and lower toggle link 144 to be influenced by the spring (not shown) attached to intermediate toggle link pivot pin 156 to cause rotation of the crossbar assembly 100 at the pivotal interconnection 142 with the crossbar thus causing the contact carrying arm 58 to move in a counterclockwise direction to cause contact 62 to forcibly abut contact 64 to form a closed circuit between load conductor 50 and line conductor 71.

In the arrangement depicted in FIG. 6 the handle 42 has been rotated to the right to a rotational position indicative of the contacts being OPEN. The handle position corresponds with a legend on the auxiliary cover 22 which clearly indicates the status of the circuit breaker contacts as being OPEN. Correspondingly, in the representation depicted in FIG. 7 where the contacts 62 and 64 are closed, the handle has been rotated to the left or counter-clockwise to a rotational disposition indicated by a legend on the auxiliary cover 22 of the contacts being CLOSED.

Figure 8:
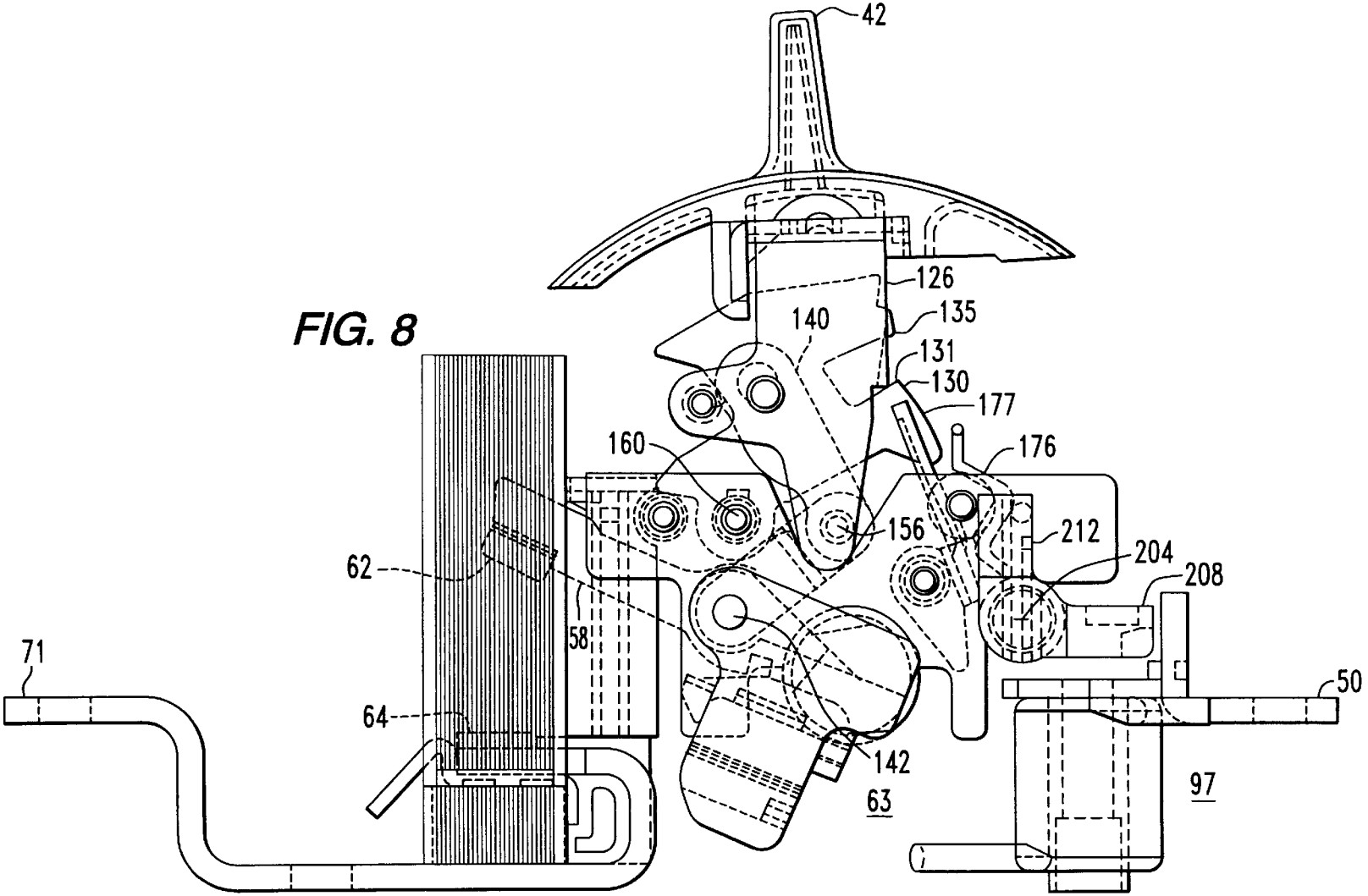
FIG. 8 shows an arrangement similar to FIG. 6 but with the contacts and handle in the TRIPPED state.

Referring now to FIG. 8, the TRIPPED disposition of the operating mechanism 63 is depicted. In particular, the TRIP disposition is related to an automatic or magnetically induced disposition of the circuit breaker in which the circuit breaker automatically opens in response to electro-magnetic or other stimulus related to the magnitude of the current flowing between the line conductor 71 and the load conductor 50. In particular, a solenoid assembly 97 is provided which is interposed electrically between the load conductor 50 and the movable contact arm 58 and is thus exposed to the full electrical current flowing through the electrical contacts 62 and 64 when they are closed. In the event that that load current exceeds a predetermined amount, the solenoid 97 interacts by way of an electro-magnetically controlled plunger (not shown herein for purposes of simplicity of illustration) to induce the trip bar assembly solenoid armature interface 208 to move downwardly, in response to the electromagnetic action of the solenoid assembly 97, in a clockwise direction about a trip bar assembly pivot 204 to cause the attached trip bar assembly intermediate latch interface 212 to rotate correspondingly away from the intermediate latch 176 thus freeing the cradle assembly 130 which had been held in place at the latch region 131 in the cradle assembly latch cutout 135 to be rotated counter-clockwise under the influence of the tension springs (not shown) interacting between the top of the handle mechanism 126 and the intermediate toggle link pivot pin 156. This collapses the later toggle arrangement. This in turn causes the pivotal interconnection 142 to be rotated clockwise and upwardly to thus cause the crossbar 100 to rotate in a similar manner thus causing contacts 62 and 64 to be separated by the clockwise motion of the movable contact arm 58. In this disposition the cradle assembly 130 has been rotated to the left or in a counter-clockwise direction about its axis 160, thus causing the cradle member arcuate surface 177 to ride against the upper arm of the intermediate latch 176 thus keeping the lower arm thereof free from interconnection with the trip bar assembly intermediate latch interface 212 even thought that interface may have been moved back into the latching disposition by the cessation of the high current flowing in the solenoid assembly 97. In this disposition, the handle 42 is maintained in an intermediate disposition between its disposition in the CLOSED state as shown in FIG. 7 and the OPEN state as shown in FIG. 6. This disposition between the full off and full on positions is depicted on the secondary cover 22 of the circuit breaker 10 as an indication that the circuit breaker is in the TRIPPED state. Once in this disposition the circuit breaker may not be turned on again until it is RESET as will be described hereinafter. After that the handle 42 may be rotated in the counter-clockwise direction to the ON state depicted in FIG. 7 for causing the contacts 62 and 64 to close once again and abut each other in the arrangement of the operating mechanism 63 depicted in FIG. 7.

Figure 9:
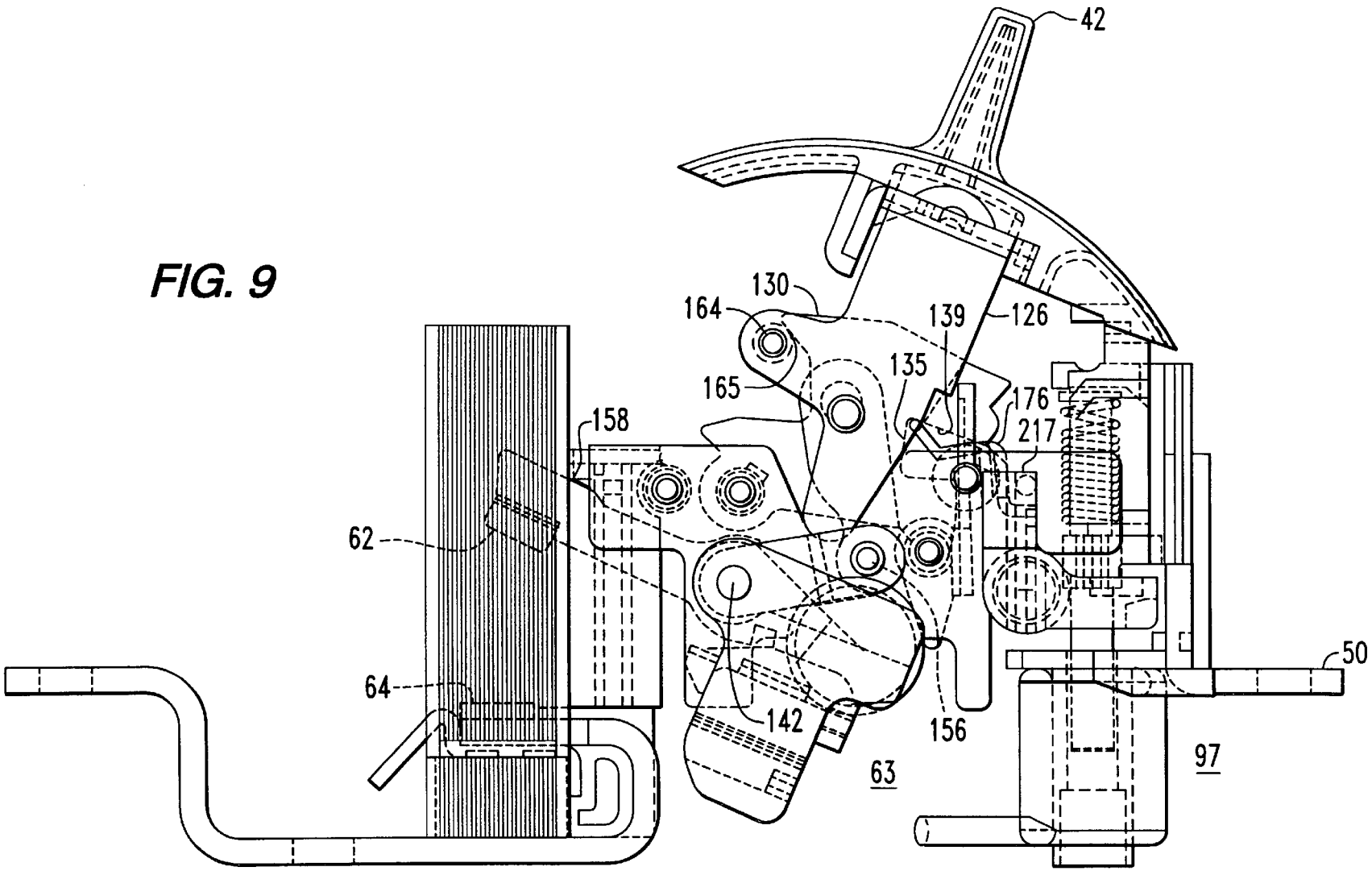
FIG. 9 is similar to FIG. 6 but with the contacts open and the handle momentarily moved to the RESET state.

Referring now to FIG. 9, the disposition of the operating mechanism 63 during resetting operation is depicted. This occurs while the contacts 62 and 64 remain open and is exemplified by a forceful movement of the contact handle 42 to the right or in clockwise direction after a tripping operation has occurred as described with respect to FIG. 8. The forceful movement of the arm 42 to the right or towards the OPEN indication on the secondary cover 22 (not shown) of the circuit breaker causes fixedly attached handle assembly 126 to move correspondingly. The handle assembly roller 164 makes contact with the back portion 165 of the cradle assembly 130 thus forcing it to rotate clockwise against the tension of the springs (not shown) located between the top of the handle mechanism 126 and the intermediate toggle link pivot point 156 until the upper portion 139 of the cradle assembly latch cut-out 135 abuts against the upper arm of the intermediate latch 176 forcing that intermediate latch to rotate to the left or counter-clockwise so that the bottom portion thereof, also rotates counter-clockwise to the right to a disposition of interlatching with the trip bar assembly intermediate latch interface 212. Thus when the force against the handle 42 is released it rotates backwardly over a small angular increment in the counter-clockwise direction thus causing the latch region of the cradle assembly to forcefully abut against the intermediate link 176 which is now abutted at its lower end thereof against the trip bar assembly intermediate latch 212 and is kept in that position by the influence of the previously described spring. In this disposition, the circuit breaker handle 42 may then be moved counter-clockwise or to the left towards the on disposition depicted in FIG. 7 without the latching arrangement being disturbed until the contact 62 and 64 are rotated by way of the movable contact arm 58 into a disposition of forceful electrical contact with each other. Once this occurs, a tripping operation such as depicted and described with respect to FIG. 8 may take place causing the contacts to open once again.

Under certain circumstances associated with the tripping action shown and described within respect to FIG. 8, the moveable contact arm 58 may independently pivot about its pivot 142 under the influence of extremely high current by way of well understood magnetic action causing the contacts 62 and 64 to separate in a period of time faster than can normally occur as the result of the action of the solenoid assembly 97 as was described previously. This operation will be further described with respect to FIGS. 3, 5, 16A and 16B where the blow open arrangement of the circuit breaker is described in greater detail.

Referring now to FIG. 10, a portion of the operating mechanism 63 broken away from other portions of the circuit breaker 10 as well as portions of the movable and stationary contacts 62 and 64 and the associated supports therefore are shown. In FIG. 10 the contacts are shown in the closed state with moveable contact arm 58 causing movable contact 62 to abut against stationary contact 64 as disposed on stationary contact support arm 68. A portion of the separation wall 69 between the operating mechanisms 63 and the arcing chamber to the left is shown. The separation wall 69, in addition to providing physical structure for the circuit breaker, also provides a barrier wall to assist in preventing hot gases from the arcing area on the left from escaping rightwardly towards the operating mechanism 63 on the right. The height of the separation wall 69 is limited by the need for the contact arm 58 to protrude from the region of the operating mechanism 63 to the region of the contact 64. In the depicted disposition the contacts remain closed but the handle mechanism 126 has been pivotally rotated to the right as in a opening operation or a tripping operation. In this state an indication must be provided for indicating to an observer that the contacts have not opened, even though it may appear that an opening operation has occurred. In particular, cross bar 100 which has a cross bar positive operating protrusion 101 disposed thereon abuts against positive off-link 188 which is in turn rotated counter-clockwise thereby about its rotational axis 192. This thrusts the positive off-link extension 1890 into the path of the handle assembly cutout 137. This prevents the handle mechanism 126 which is pivotally supported at 128 by an internal handle support member 127 from rotating any further about its pivot point to the right or in a clockwise direction. This prevents the handle 42 from indicating that the circuit breaker is OFF when in fact it is not. In this contact-welded closed disposition, clear indication is thereby given to operating personnel that the circuit breaker contacts are closed and therefore care must be exercised in servicing or otherwise working with the line or load devices interconnected with the circuit breaker.

Figure 11:
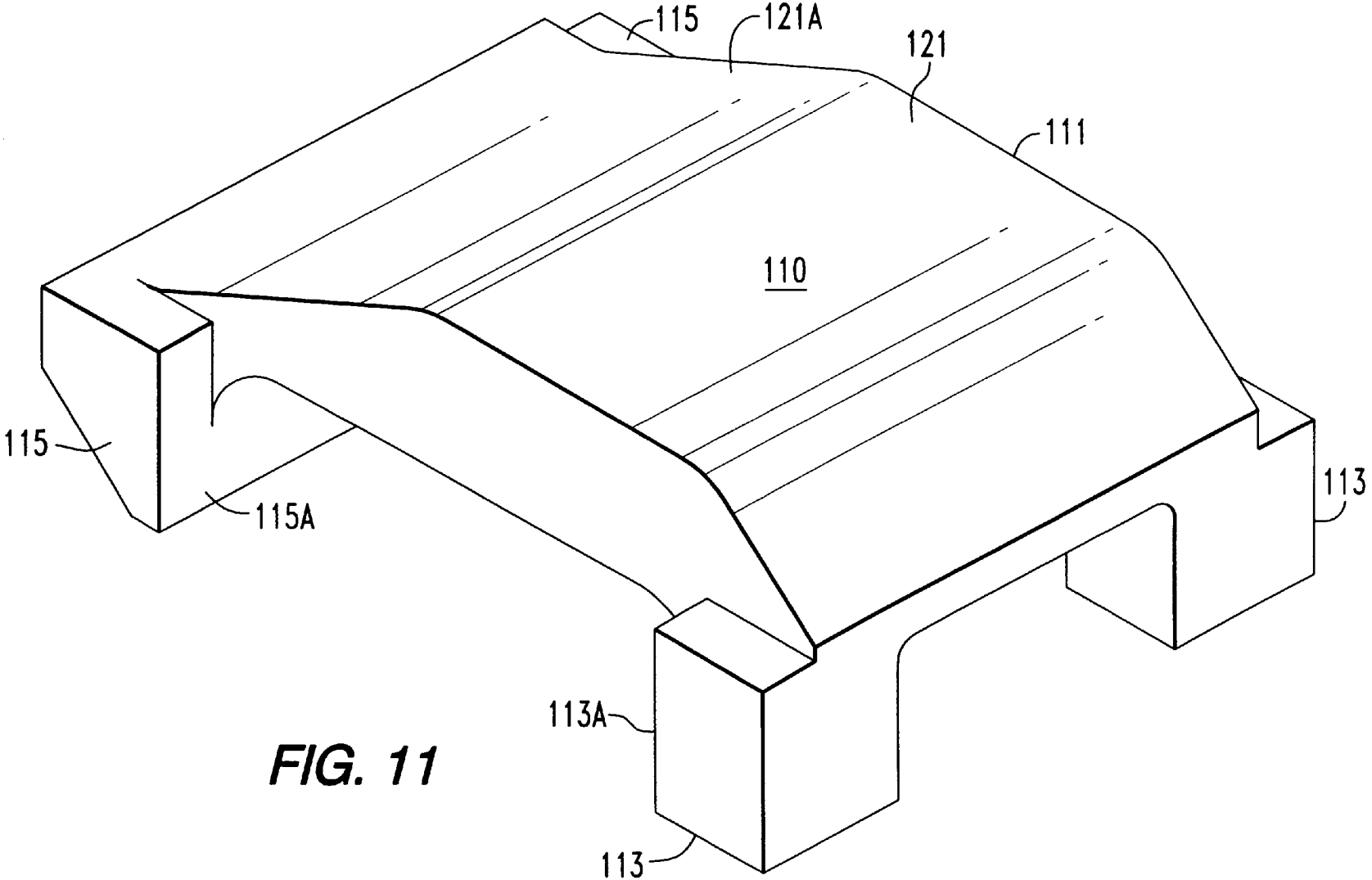
FIG. 11 shows an orthogonal view of a cam rider.
Figure 12:
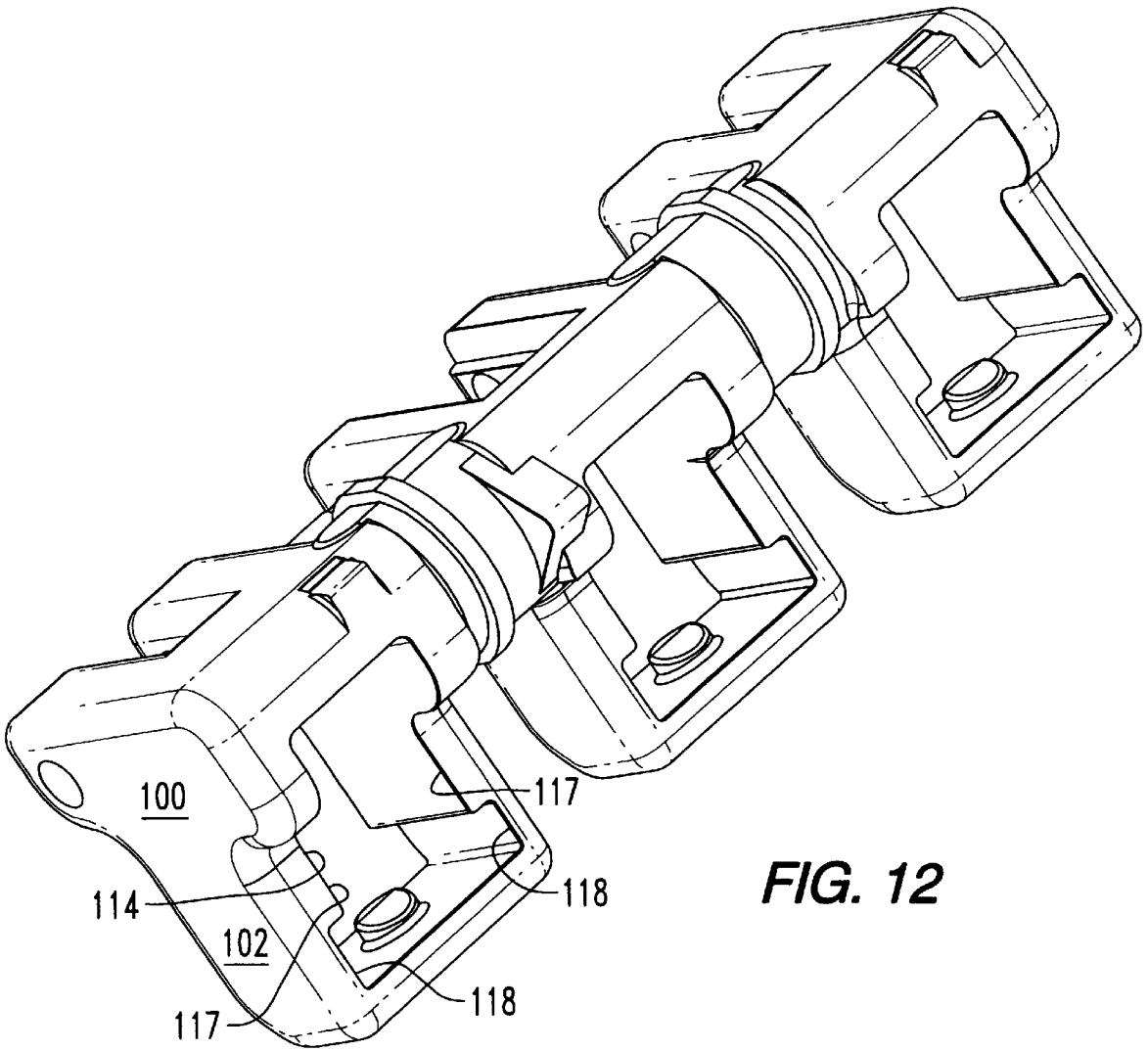
FIG. 12 shows a portion of the crossbar arrangement into which the cam rider is disposed.

Referring now to FIGS. 11, 12 and 13, there is shown a cam follower, crossbar, cam housing arrangement and movable contact disposed in the blown open disposition. The cam follower 110 comprises a main body 111 having on the rear thereof two oppositely disposed transversely protruding cam follower rear tabs 113. Correspondingly in the front thereof there are two transversely protruding oppositely disposed cam follower front tabs 115. On the top of the main body 111 is provided a cam follower top rear cam surface 121 and on the front thereof is provided a cam follower top front cam surface 121A. The cam follower housing 102 disposed on the crossbar assembly 100 includes a cam follower opening 114 having on the inside thereof an inside wall and a pair of oppositely disposed parallel inside wall guides 117 disposed upwardly along the housing 102. Disposed below the aforementioned guide walls 117 are oppositely disposed, parallel, longitudinally extended inside wall grooves 118. When assembling the cam follower 110 into the cam follower housing 102, the tabs 113 are aligned in the grooves 118 in the front of the housing 102 and then pushed inwardly towards the rear. This movement continues until the rearwardly protruding facing surfaces 115A align with the front of the housing body 102. At this point the rear tabs 113 have cleared the rear most portion of the groove 118. At this point the cam follower 110 is raised so that the frontwardly facing surfaces 113A and the rearwardly facing surfaces 115A may slide respectively against the rearward and frontward facing walls formed transversely of the side walls 117. Thereafter spring 112 is disposed between the top of the bottom most portion of the housing 102 and the lower inner surface of the cam 110 against which it is seated. The pressure of the spring 112 maintains the tabular members 115 and 113 clear of the grooves 118 and against the front and rear portions of the walls 117 respectively, thus restraining movement of the cam follower 110 in the housing 102 to upward and downward. As best seen in FIG. 13, when a magnetic blow-open condition occurs as was described previously, contact support arm 58 immediately forcefully rotates about its pivot 104 in a clockwise direction thus bringing attached contact 62 with it, thus separating contacts 62 and 64 (not shown). The contact arm rotational motion is prevented from continuing in the clock-wise direction by the main stop bar 168 (not shown). Since the cross bar assembly 100 has not begun to react to the circuit breaker magnetic trip opening action it remains in place rotationally on its axis 105. However, the rotation of the movable contact arm 58 causes the rearwardly extending movable contact cam surface 106 thereof to move away from the cam follower top rear surface 121 towards the cam follower top front cam surface 121A whereupon it depresses the cam follower 110 against the spring 112 thus moving the cam follower down the walls 117 to a disposition where the front of the cam tends to close off a significant portion of the front of the cam follower housing opening 114 thus protecting the spring member 112 from hot gas 149 which is forcefully blown over the wall 69 towards the region of the cam follower 110 and spring 112 during current interruption.

Figure 14:
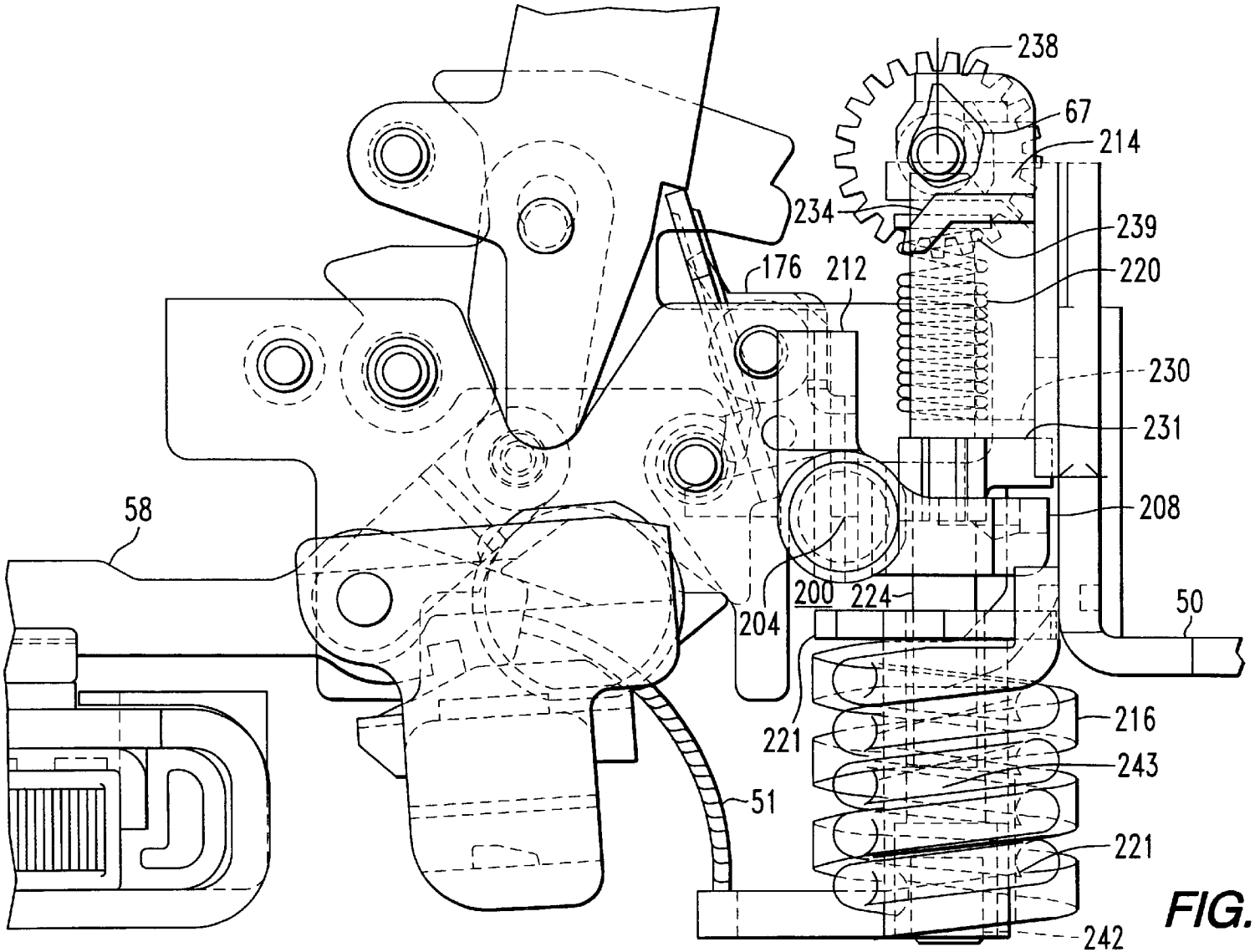
FIG. 14 shows a side elevation partially broken away of the trip mechanism of the circuit interrupter of FIG. 1.

Referring now to FIG. 14, a partially broken away, sectional view of the trip mechanism of one embodiment of the invention is depicted. In particular, there is shown the trip bar assembly 200 which includes as part thereof the trip bar assembly intermediate latch interface 212 protruding upwardly and the trip bar assembly solenoid armature interface 208 protruding to the right. Trip bar assembly 200 is disposed to rotate against a bias torsion spring (not shown) around trip bar assembly pivot 204. The bias spring biases the trip bar assembly in the counter-clockwise direction. As was described previously there is disposed below assembly 200 a solenoid coil 216 which is interconnected with load terminal 50 and by way of a braid or flexible conductor 51 with the rear most portion of the movable contact arm 58. A solenoid armature guide 221 is in place for capturing therein and guiding therein in a direction longitudinal of the solenoid coil 216 a movable core 224. The upper end of the movable core 224 is interconnected with a magnetic trip upper assembly 214. The movable core 224 has disposed thereon a movable core plunger 231. There is also provided a multi-rate or multi-pitch magnetic trip spring assembly lifter 238, the bottom of which comprises a spring seat 239 and the top of which is vertically disposable as a function of the trip adjustment cam mechanism 67. An upper interface seat 234 is provided. The multi-rate magnetic trip spring 220 is disposed around the movable core 224 between the fixed spring seat 239 on the top and the movable multi-rate magnetic trip spring seat 230 on the bottom. Adjustment of the cam 67 causes the movable spring seat 230 on the bottom to transpose axially, thus changing the air gap 246 without affecting the length of the spring 220. There is provided on the bottom of the core 216 in the channel of the solenoid armature guide 221 a stationary core 242. Electrical current flowing between the line terminal 50 and the conductive braid 51 causes the coil 216 to induce a magnetic field in the air gap 243 between the stationary core 242 and the movable armature or core 224. The strength of the magnetic flux or magnetic force in the air gap 243 is a function of the amount of current flowing in the coil 216 and the size of the air gap 243. This force has a tendency to draw the movable core 224 towards the stationary core 242 to reduce the size of the air gap 246 and is resisted by the multi-rate magnetic trip spring 220. As the movable core 224 move towards the stationary core 242, the plunger 230 causes the trip bar assembly solenoid armature interface 208 to move downwardly causing the trip bar assembly 200 to rotate about its pivot point 204 in a clock-wise direction against the force of its torsion spring. This causes the rigidly attached trip bar assembly intermediate latch interface 212 to move away from the intermediate latch 176 in the manner described previously to allow the latch to be freed. This causes the circuit breaker mechanism to trip in the manner described previously. Adjustment of the cam 67 causes the air gap 243 to change. The spring 220 is formed with a multiple winding pitch with more windings per unit axial length at the bottom thereof and less windings per unit axial length at the top thereof. However, other winding arrangements may be used to accomplish the same purpose using different spring factors: continuous movable spring pitch, different spring wire diameters, different spring materials. Thus the magnetic force induced in the solenoid coil by current flowing through the solenoid will cause the plunger 224 to move down slowly at first until all of the tightly wound spring pitch members have been compressed after which the coil will move more quickly as the more loosely wound spring coil pitch members are utilized to resist the movement of the core. This allows for a wider range of trip adjustment which may be, for example, from three times full rated current to eleven time full rated current. The exact adjustment of the tripping point is determined at least in part by the orientation of the cam member 67.

Figure 15:
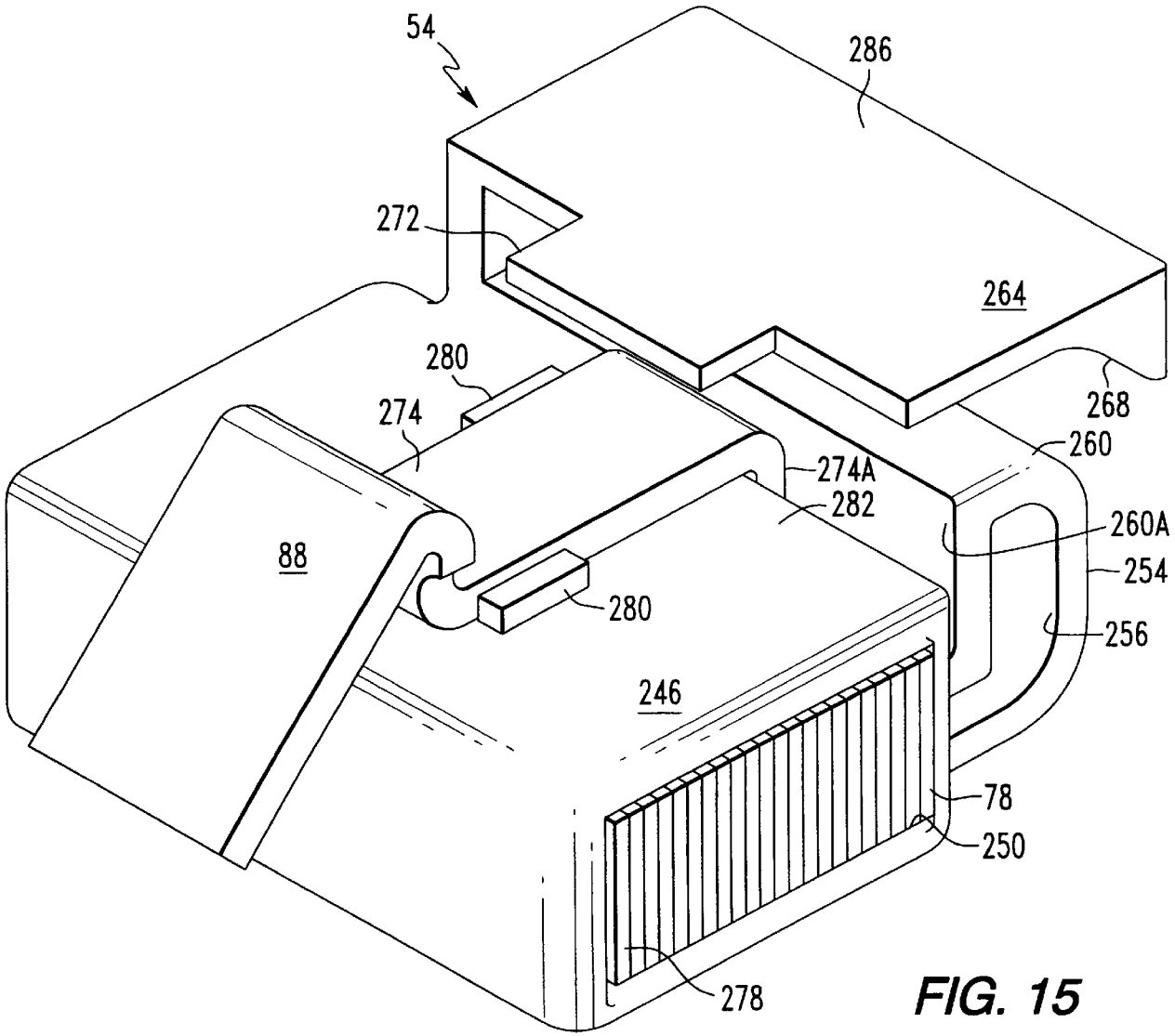
FIG. 15 shows an orthogonal view of the lower contact support member and housing including the arc runner of the circuit interrupter of FIG. 1.
Figure 16A:
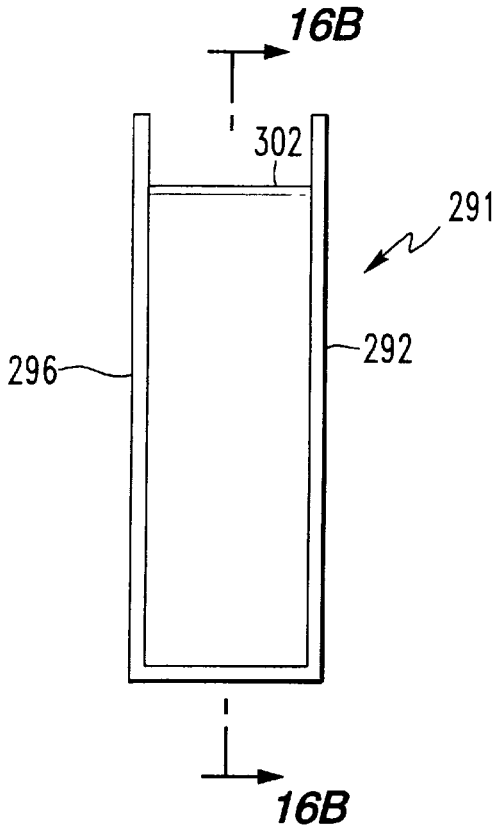
FIG. 16A shows a side view of the upper slot motor housing of the circuit interrupter of FIG. 1.
Figure 16B:
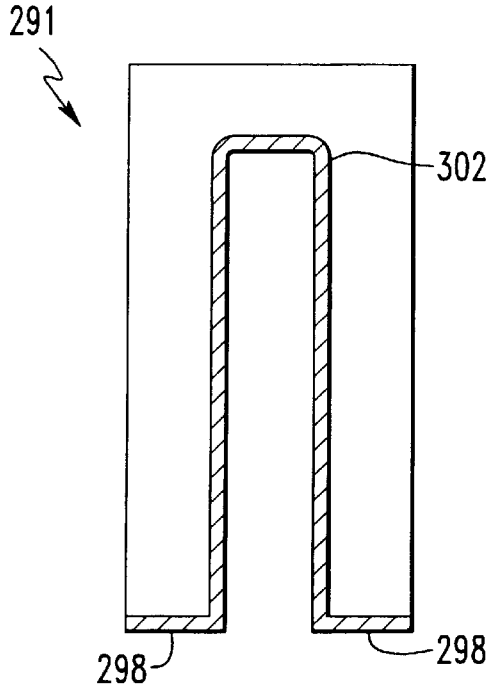
FIG. 16B shows a front view of the housing of FIG. 16A.
Figure 16C:
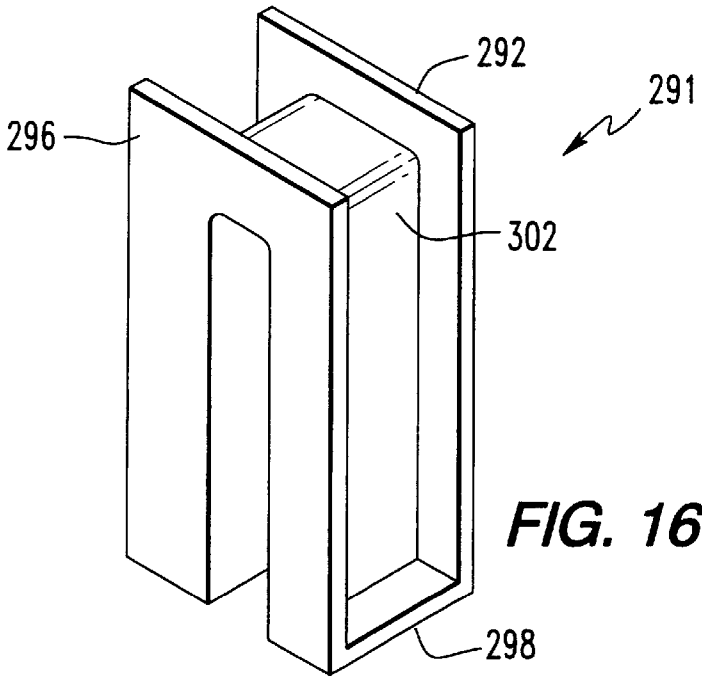
FIG. 16C shows an orthogonal view of the housing of FIGS. 16A and 16B.

Referring now to FIG. 3 and FIG. 15, the lower slot motor assembly and fixed contact support member 246 is depicted. Member 246 has a lower slot motor assembly arc plate opening 250 into which the lower arc plates 78 are disposed in a side-by-side layered relationship. These magnetic members form the lower part of the completed circuit of the magnetic slot motor 54 as described previously. Element 254 is disposed on and forms part of the right most portion of the lower slot motor assembly and fixed contact support member 246. It comprises a curvilinear member having a central opening or hollow recess 256 and a curved main contact support member surface 260. There is also provided a main contact support upper region 264. The aforementioned lower arc plate opening 250 and its surrounding housing member as well as the main contact support 254 and the main contact support upper region 264 are formed integrally of a single piece of material which may, for example, be molded material having high electrical insulating characteristics and strong structural characteristics. The main contact support upper region 264 has a lower concave surface 268 and main contact support upper region 286. The main contact support upper region 286 also has a peninsula 272 extending therefrom upon which the movable contact arm 58 (not shown) rests in the close contact disposition thereof. Arc runner 88 is shown disposed along the upper surface 282 of the housing 246. It is captured between a pair of upper contact support protrusions 280 which are integrally molded into the aforementioned housing 246. By referring also to FIG. 3, it can be seen that the fixed contact arm 68 comprises a U-shaped member interconnected with the line terminal 71 on one end and the fixed contact 64 on the other end. The curved U-shaped member is disposed around the main contact support 254 so that the upper part of the U-shaped member is captured between outer surface 260 and concave surface 268 while the lower or other part of the U-shaped portion is disposed under the housing exemplified by the lower slot motor assembly 246. The thusly captured support arm 68 bears downwardly against the upper surface 274 of the arc runner 88 and holds it in place against the upper part 282 of the housing 246 with the tabular members 280 preventing sideways motion of the arc runner 88. The arcing contact 88 cannot move longitudinally because it has an end 274A thereof which is offset at right angles to the main portion thereof and is trapped in a grooved formed by one side of the housing 246 and the inner side of the main contact support 254.

Referring now to FIGS. 3, 5, 15, 16A, 16B and 16C, the upper slot motor assembly housing 291 is depicted. It comprises a rear plate 296, a front plate 292 and an inner-support or mandrel 302. The shape of the inner-support 302 is basically that of a U. Disposed on the U shaped inner-support 302 around the bite piece thereof and extending from one foot 298 to the other thereof are corresponding U-shaped layered magnetic plates 74 which correspond generally in a one-to-one relationship to the plates 78 shown in the opening 250 in the housing 246 of FIG. 15. These plates are aligned in a layered manner from the front plate 292 to the rear plate 296. When thusly assembled, assembly housing 291 is disposed on top of the lower slot motor assembly 246, so that feet 298 are disposed on either side of the arc runner 88 as shown in FIG. 15. The central opening formed thereby provides a slotted channel in which the movable arm 58 may reside and traverse during a contact opening or closing operation. Electrical current continues to flow in the movable contact arm 58 and through an electric arc between contacts 62 and 64 during a contact opening operation. This current induces a magnetic field into the closed magnetic loop provided by the combined upper and lower plates 74 and 78 respectively in the upper contact assembly 291 and lower contact assembly 246 respectively. This magnetic field interacts with the aforementioned current electromagnetically in such a way as to accelerate the movement of the opening contact arm 58 in such a manner as to more rapidly separate contacts 62 and 64. The higher the electrical current flowing in the arc the higher the magnetic interaction and the more quickly the contacts 62 and 64 separate. For very high current this provides the aforementioned blow open operation associated with FIG. 13. This operation is also described in the aforementioned U.S. Pat. No. 3,815,059 to Spoelman. Also the material of the housing 291 may comprise a gas evolving material such as cellulose filled Melamine Formaldehyde which helps to move the arc toward the arc chute and it flattens it against the arc plates in the form of a band or ribbon. This shape makes it easier to split the arc and move it into the arc chute, thereby obtaining the high level of arc voltage required.

Figure 17:
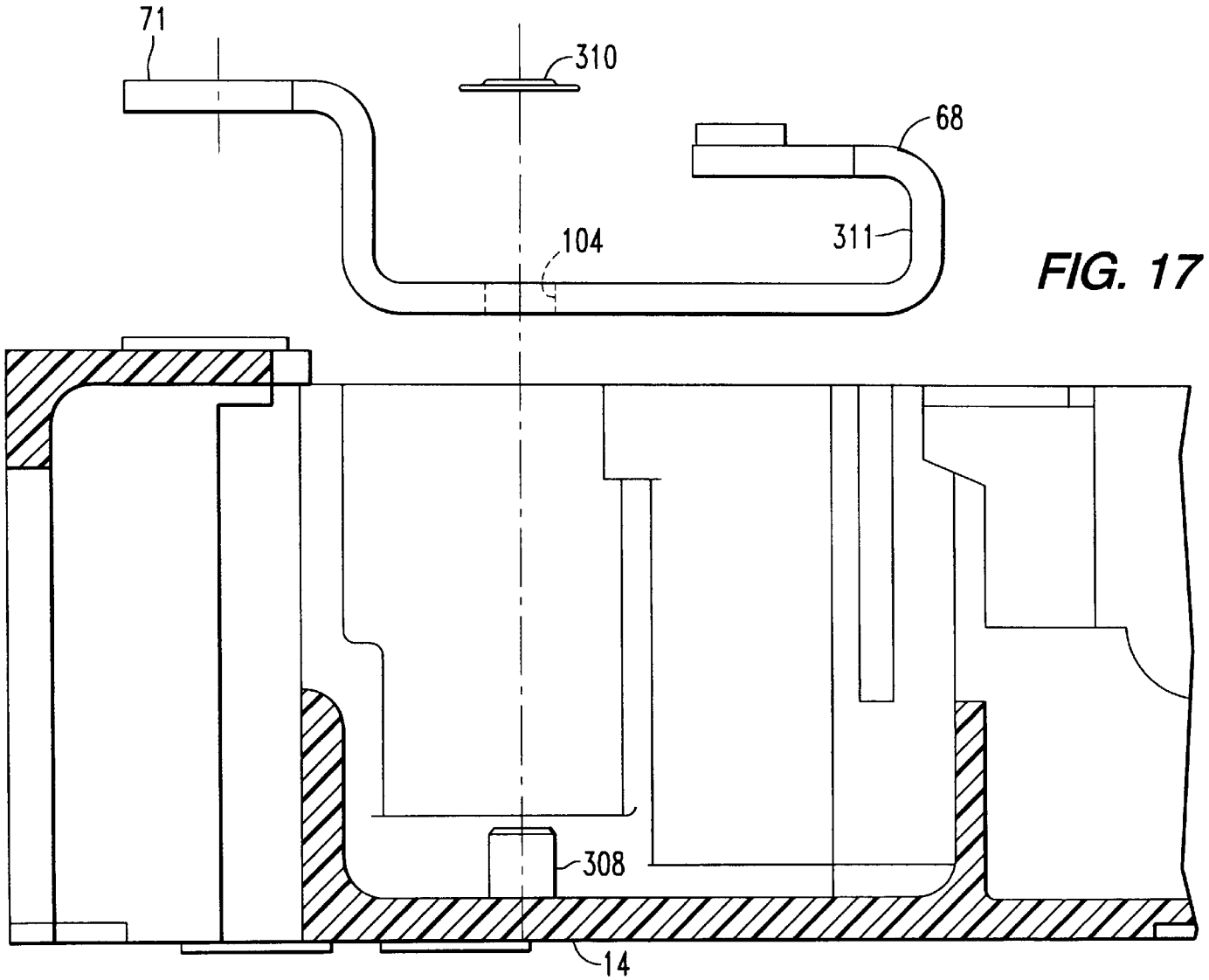
FIG. 17 shows an exploded, side elevation, partially broken away orthogonal view of the mounting arrangement for the LINE conductor for the circuit interrupter of FIG. 1.

Referring now to FIGS. 3, 15 and 17, an attachment arrangement for the line conductor 71 and fixed contact support member 68 is depicted. In particular, a cut away portion of the base member 14 is shown in FIG. 17. The stationary arm 68 with its characteristic U-shape is terminated in an offset load terminal 71. There is provided in the base 14, a line conductor fastening post 308. A hole or opening 104 in the contact arm 68 fits over and around the post 308. A line conductor retaining ring 310 is disposed on the fastening post 308 after the contact arm 68 has been placed thereon. Thusly configured and attached the fixed contact arm 68 is securely fixed in and to the base 14 by way of the line conductor fastening post 308 and retaining ring 310. The region 311 in the bite portion of the U-shaped member 68 is designated as the lower slot motor assembly region and it is in this region that the previously described lower slot motor assembly 246 is disposed as can be best seen by reference to FIGS. 3 and 15.

Figure 18:
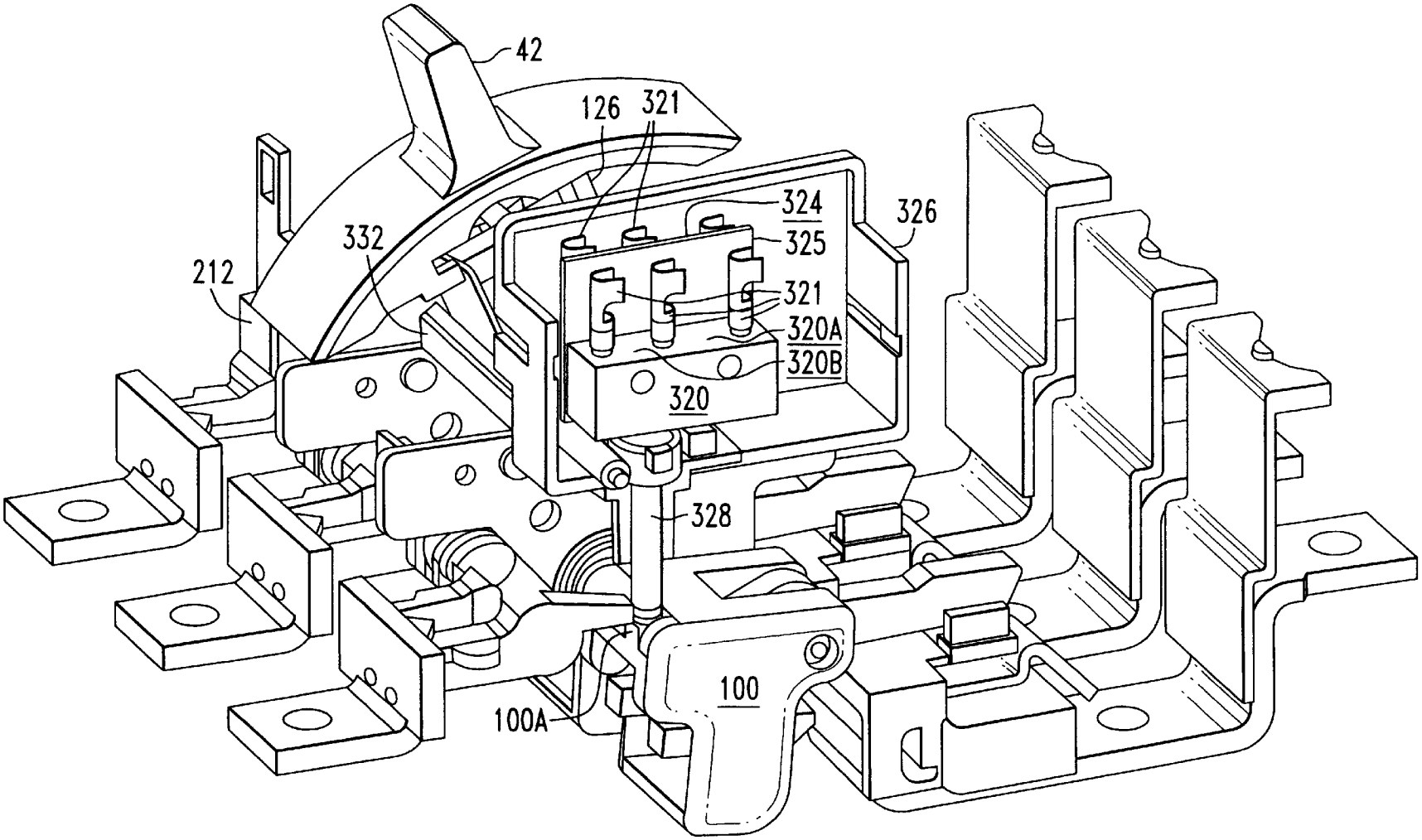
FIG. 18 shows an orthogonal view partially broken away of the auxiliary switching arrangement for the circuit interrupter shown in FIG. 1.

Referring now to FIGS. 5 and 18, the disposition of an auxiliary switch 320 and a bell alarm 324 is shown. In particular there is an enclosure 326 shown partially broken away inside of which the auxiliary switch 320 is shown. Alternatively, a pair of auxiliary switches 320 or a pair of bell alarms 324 may be disposed within the enclosure 326 or the disposition of the auxiliary switch 320 and bell alarm 324 may be reversed. The bell alarm 324 is disposed in the same housing 326 on the other side of an insulating auxiliary wall 325. Switch 320 has protruding from the bottom thereof an axially movable cam follower 328 which follows the upper cam surface 100A of the cross bar assembly 100. As described previously, when the contacts 62 and 64 are closed, the assembly 100 is in one disposition and when the contacts 62 and 64 are open, the assembly is in a second disposition. The difference between the dispositions is tracked by the cam follower 328. The cam follower 328 interconnects with contacts (not shown) in the auxiliary switch 320 such that normally open contact 320A is in one disposition when the contacts 62 and 64 are open and in the opposite disposition when the contacts 62 and 64 are closed. The complimentary set of contacts 320B are in the opposite dispositions at these times. Electrical wiring 320C as shown in FIG. 5 may be interconnected with the terminals 321 and provided to a remote location. Appropriate power for causing certain desirable functions as a result of the status and/or change of status of the auxiliary switch 320 may be provided to a subset of these wires. There is also provided a cradle follower 332 which protrudes at a right angle relative to the cam follower 328 from the other side of the enclosure 326 for interacting with or actuating the bell alarm 324. Depending upon the status of the handle mechanism 126, the cradle follower 322 may cause the bell alarm 324 to be in a first electrical disposition or a second electrical disposition. This arrangement may be used to alert operating personnel that the contacts are either opened or closed. Both the auxiliary switch 320 and alarm 324 are contained within one enclosure 326 which is independently removable from the circuit breaker mechanism without complete disassembly thereof by removal of the aforementioned secondary or auxiliary cover 22 (not shown) and subsequent removal of the enclosure 326. Insertion of the enclosure 326 may occur in a similar but reverse way.

Figure 18B:
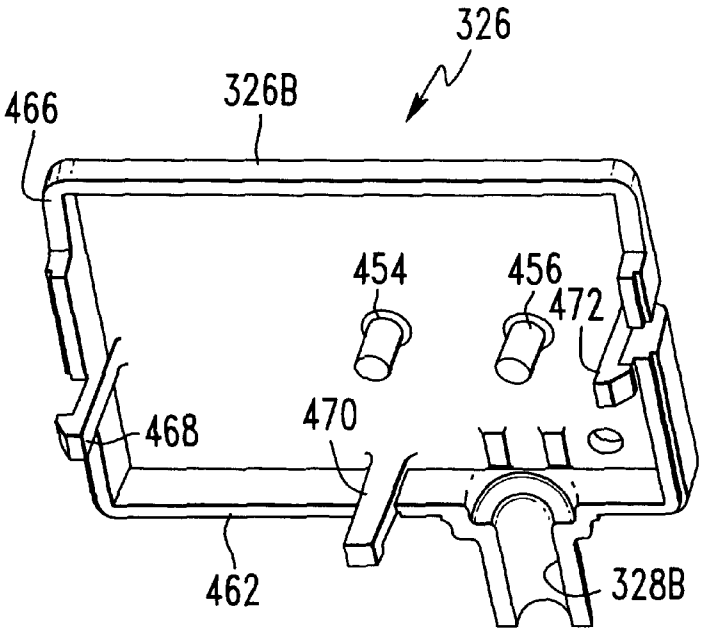
FIG. 18B shows an orthogonal view of the complimentary section of the switch module shown in FIG. 18.
Figure 18A:
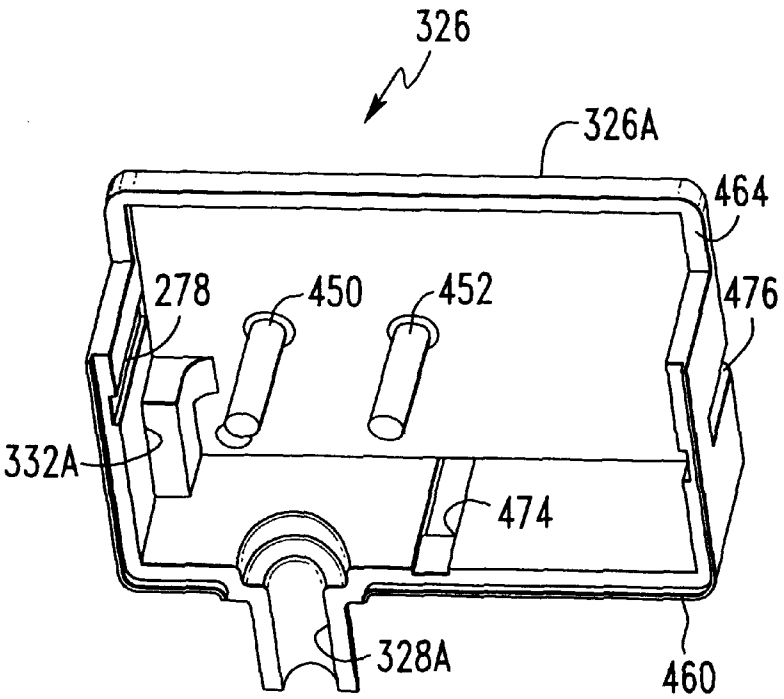
FIG. 18A shows an orthogonal view of one section of the auxiliary switch module shown in FIG. 18.

Referring now to FIGS. 18A and 18B, the detailed construction features of the enclosure 326 is depicted. In particular in FIG. 18A there is depicted that portion of the switch arrangement 326 shown in its entirety in FIG. 18. In particular portion 326A comprises an opening 332A through which the bar 332 of FIG. 18 protrudes outwardly beyond the case 326. Also one-half of the guiding arrangement 328A for the plunger 328 of FIG. 18 is also shown. Two horizontal poles 450 and 452 are provided for matching up with complementary openings in the bell alarm or auxiliary switch of FIG. 18 for disposition of the bell alarm or auxiliary switch within the case 326. There are also provided in this embodiment three openings 474, 476 and 478. Also shown is sidewall 464 and sidewall 460. Referring to FIG. 18, the complimentary portion 326B for portion 326A is depicted. Slightly shorter poles 454 and 456 are provided for axially aligning with poles 452 and 450 respectively as the cover 326B is joined to cover 326A to form the completed switch enclosure 326. The other half of the plunger mechanism guide 328B is also shown protruding downwardly from casing 326B. There are also provided flexible snap devices 468, 470 and 472 for snappingly engaging portions of the openings 474, 468 and 478 respectively. Once this occurs, the two sides 328A and 328B joined. The sides 460 and 462 fit flush against each other and the sides 464 and 466 form an opening for access to the completed drop-in module 326 from above. The construction features for this device are similar to those used with respect to the shunt trip device 92 shown in FIG. 4 and the under voltage relay 93 shown in FIGS. 19A, B and C. The drop-in module 326 depicted in FIGS. 18, 18A and 18B drops into recess 18Y in the primary cover 18 of FIG. 2 to subsequently be covered by the auxiliary or secondary cover 22.

Referring now to FIGS. 5, 14, 18, 19A, 19B and 19C the under voltage relay and shunt trip module 92X is depicted for the circuit breaker 10. Primary cover 14 has an opening therein through which the under voltage relay in 92X is accessible. Handle 42 operates to reset the under voltage relay 92X in the manner which will be described hereinafter with respect to FIG. 19B. As is best shown in FIG. 18, the trip bar assembly 100 has an extension which constitutes a trip bar assembly under voltage relay interface 212. If interface 212 is contacted in such a manner as to rotate the trip bar in the counter-clockwise direction as shown in FIG. 14, the trip bar will cause the circuit breaker 10 to trip in a manner similar to that described with respect to FIG. 14 and the solenoid trip operation associated therewith. Thus it can be seen that the circuit breaker mechanism can be tripped by either the action of the solenoid 216, the under voltage relay 92X, or the shunt trip mechanism 92 of FIG. 4 causing the trip bar to rotate in the counter-clockwise direction as viewed in FIG. 18 (clockwise in FIG. 14).

Figure 19B:
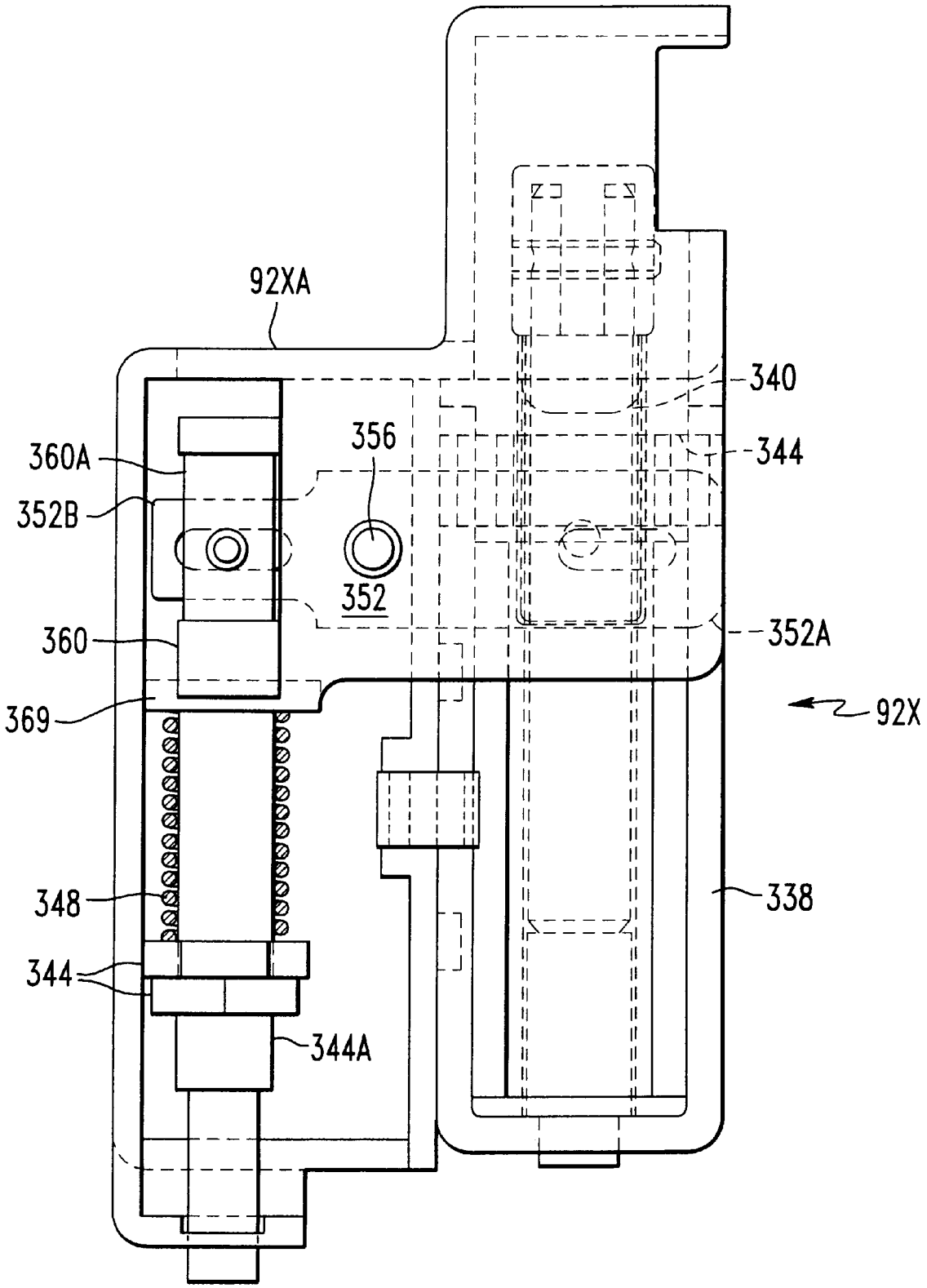
FIG. 19B shows an enlarged view of the under voltage release mechanism of FIG. 19A.
Figure 19C:
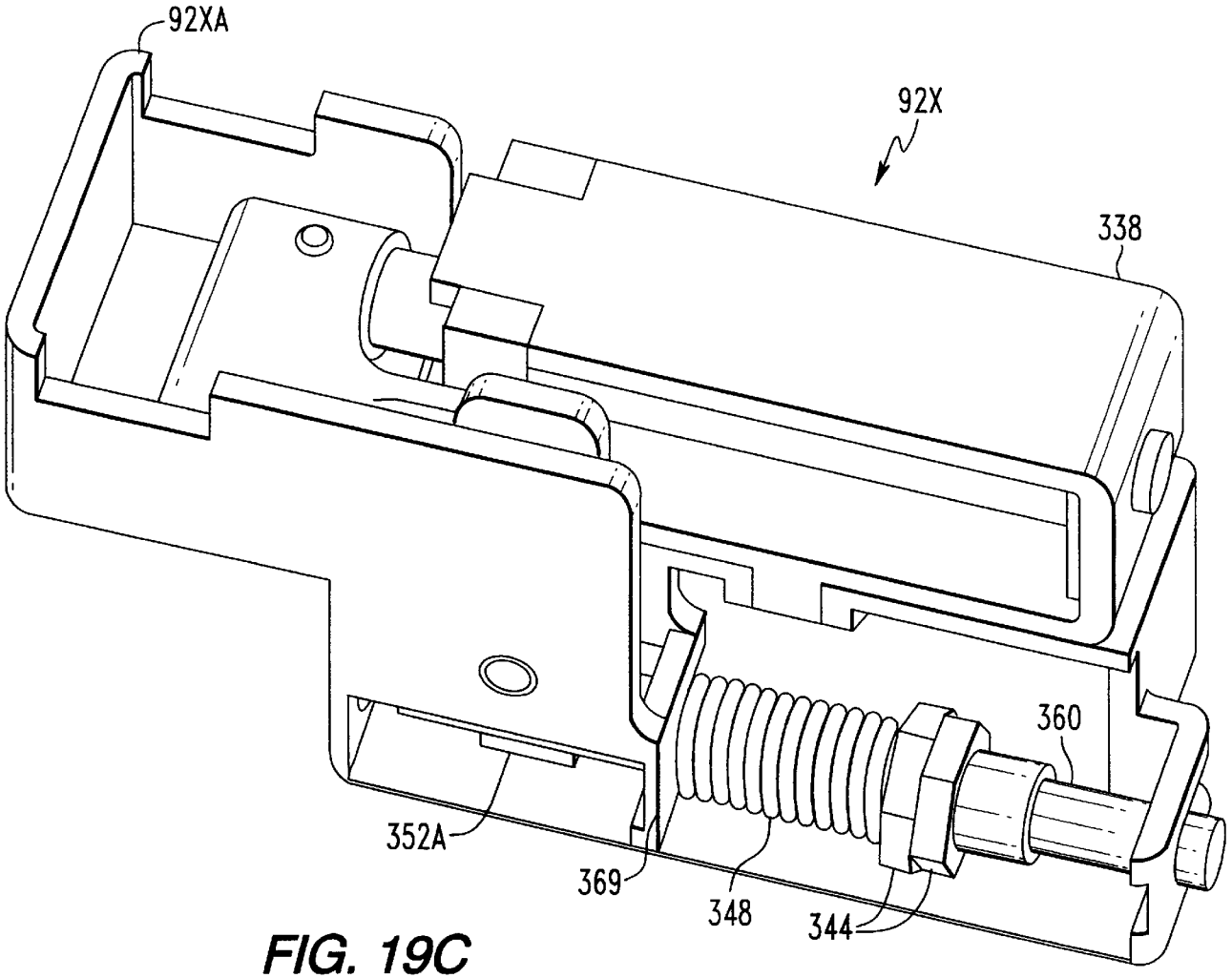
FIG. 19C shows an orthogonal view of the under voltage release mechanism of FIGS. 19A AND 19B.

Referring to FIG. 19B and 19C a top view and an orthogonal view respectively of the aforementioned under voltage relay 92X is depicted. In particular, under voltage relay 92X has an enclosure case 92XA in which the under voltage relay 92X and its mechanism are disposed. There is provided an under voltage relay coil 338 which may be energized by electrical conductors connected to the under voltage relay terminals 92B as shown best in FIG. 5. There is provided an under voltage relay plunger arrangement 340 which is generally U-shaped having a lower section and an upper section. Plunger arrangement mechanism 340 has an opening 342 therein in which the right arm 352A of the under voltage relay translating lever 352 is disposed. The under voltage relay translating lever 352 pivots above a fixed pivot 356. The left arm 352B thereof is disposed in an opening 360A in the main plunger 360 of the under voltage relay 92X. There is provided a fixed spring base or seat 369. There is also provided a screw section or threads 344A upon which an adjustment nut arrangement 344 may be disposed. Alternatively, arrangement 344 may be replaced by a thumb screw. Interposed between the fixed spring seat 369 and the adjustable nut 344 is a spring 348 which surrounds the plunger 360. By adjusting the nut 344 on the threads 344A the force necessary to cause an under voltage trip may be varied. The closer the nut 344 is moved to the fixed spring base or seat member 369 the more compression is displayed by the spring 348 and the harder it is for the under voltage relay to trip. On the other hand if the nut 344 is threaded further away from the fixed spring base or seat 369 the spring 348 is relaxed. In operation the spring 348 forces the plunger 360 against left arm 352B. The under voltage relay coil is normally on and normally holds the plunger 352 in a downward direction thus exerting force against the spring 348. In an under voltage situation, the coil 340 is de-energized as the coil voltage drops below a predetermined value, i.e. when an under voltage situation exists. Thus the spring 348 acts against the plunger 360 causing it to move outwardly to strike the trip bar assembly under voltage relay interface 212 thus causing a trip operation as described previously.

Figure 20:
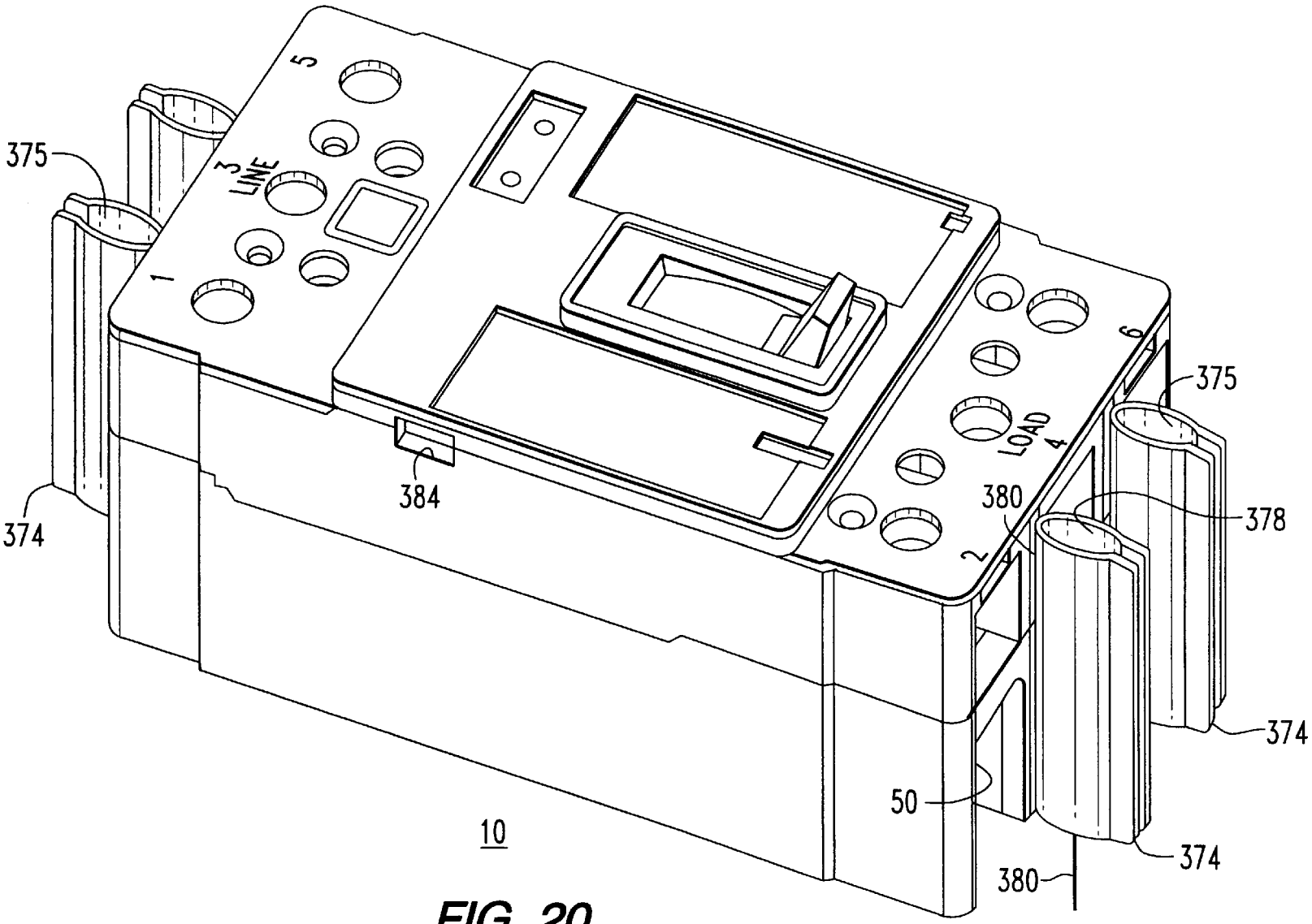
FIG. 20 shows an orthogonal view of the circuit interrupter similar to that shown in FIG. 1 but with interphase wire trough barriers in place.

Referring now to FIG. 20, an orthogonal view of circuit breaker 10 is shown. In this embodiment of the invention, combination interface barriers and wiring troughs 374 are shown in place at the ends of the circuit breaker 10. Barriers 374 are composed of insulating material and have hollow openings 375 through the longitudinal axes thereof into which electrical wiring such as auxiliary wiring 380 may be routed. Auxiliary wiring 380 may be provided to the external part of the circuit breaker 10 by way of opening 378 in the circuit breaker 10. A similar opening 384 may be provided in the side of the circuit breaker 10. In the prior art, auxiliary wiring is routed to the external part of the circuit breaker 10 from the opening 384. The presence of the combination interface barrier and wiring trough 374 provides a solid insulating barrier between the incoming power leads which are interconnected with the load terminals 50, for example.

Figure 21A:
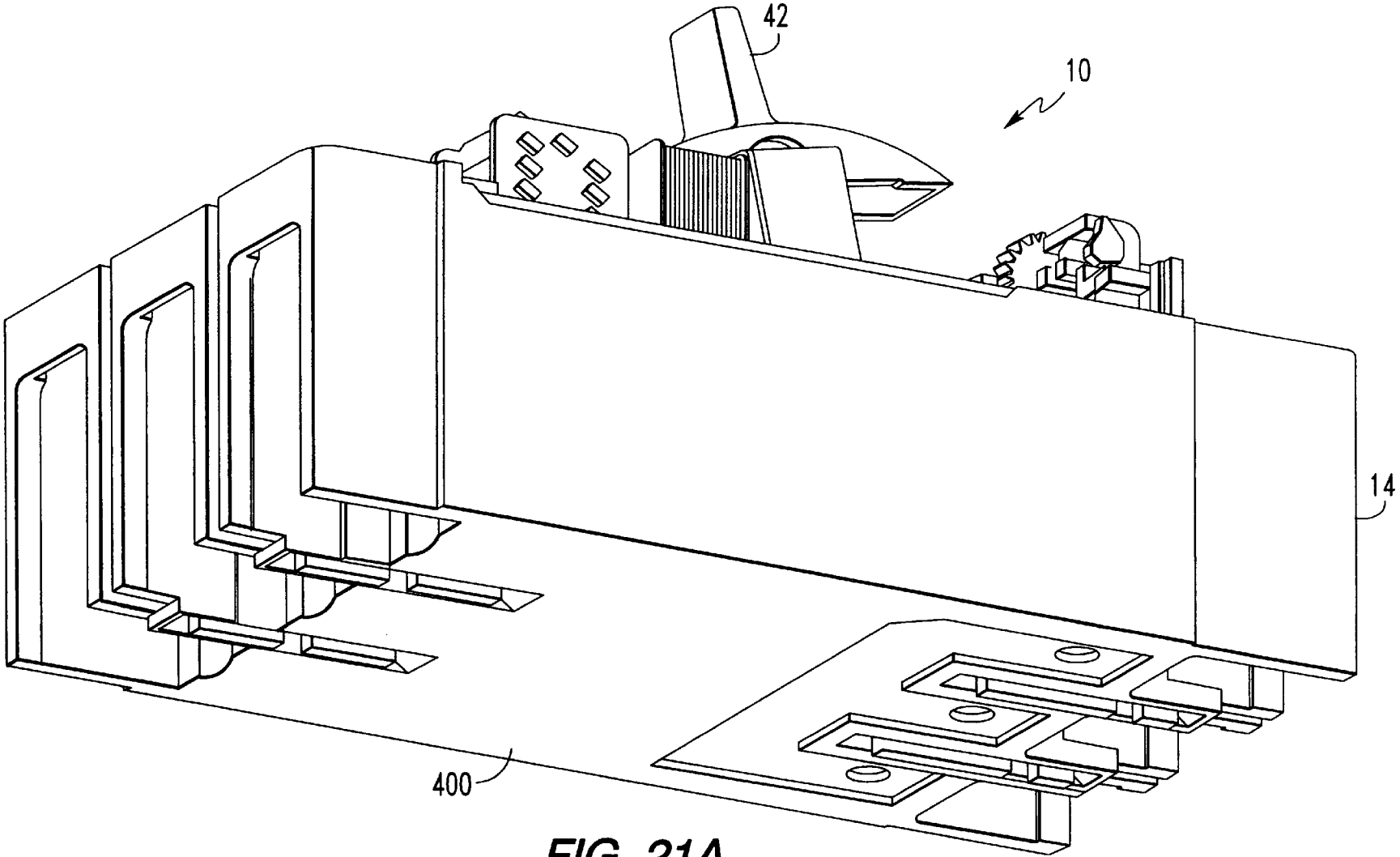
FIG. 21A shows a partially broken away orthogonal view of the circuit breaker of FIG. 1 from the back.
Figure 21B:
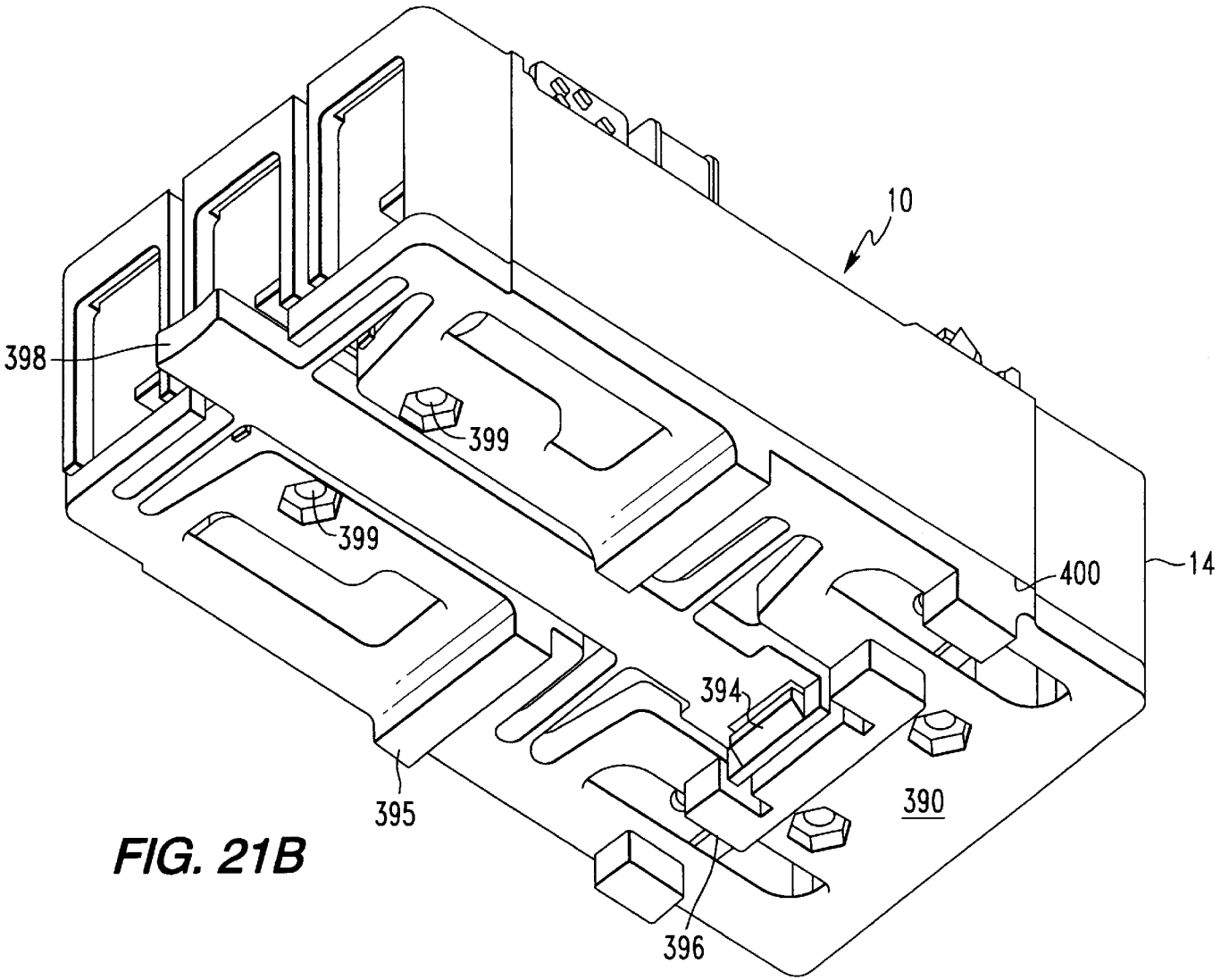
FIG. 21B shows a partially broken away orthogonal view of the circuit breaker of FIG. 1 from the back so as to depict the DIN rail attachment region.

Referring to FIGS. 21A and 21B, a DIN rail attachment 390 is shown. In both figures the circuit breaker 10 is shown in orthogonal view with the base 14 prominently displayed. In the case of FIG. 21A, the handle 42 is also shown for purposes of orientation. In FIG. 21A the back plane 400 of the base 14 is depicted. In this state the circuit breaker 10 may be directly interconnected to a wall of a load center or panel board. In FIG. 21B the DIN rail attachment 390 is shown attached to the back plane 400. There is provided a single piece DIN rail attachment 390 having a singular, movable latch 394 and an inter-connected spring loaded plunger 398. Device 390 may be securely fastened to the back plane 400 of the circuit breaker 10 by way of attachment devices 399 such as bolts. DIN rail mounting members 395 and 396 are provided for interaction with a typical DIN rail mounting arrangement. The plunger 398 may be activated to cause the movable latch 394 to clear the DIN rail during the mounting operation. The plunger 398 which is spring loaded springs back after the mounting procedure has begun causing the latch 394 to securely hold the circuit breaker 10 against the DIN rail (not shown) with the aid of members 395 and 396.

Figure 22A:
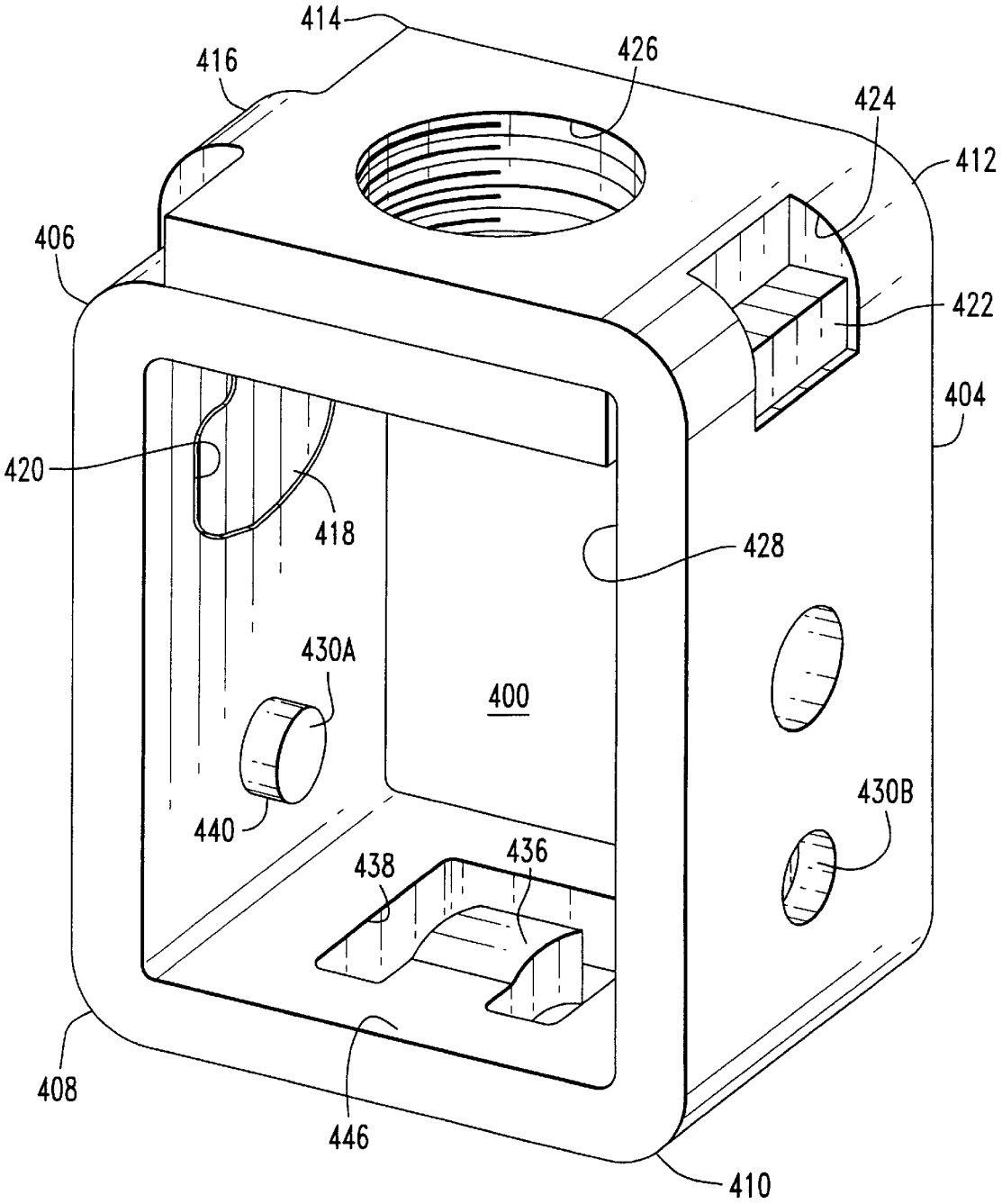
FIG. 22A shows an orthogonal view of a load or line terminal collar embodied in the present invention.
Figure 22B:
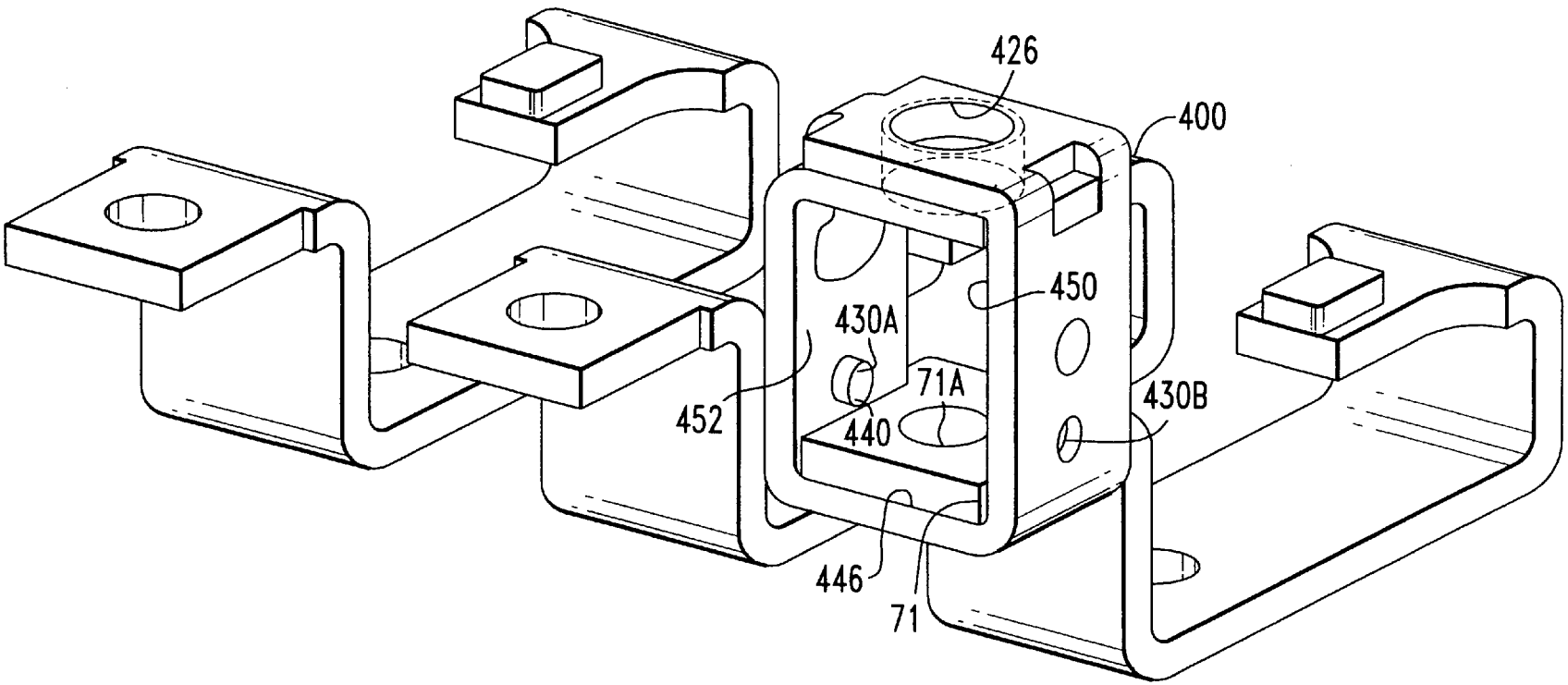
FIG. 22B shows an orthogonal view of the collar of FIG. 22A disposed upon a line conductor.

Referring now to FIG. 22A a self-retaining collar for a load or line conductor is depicted. In this embodiment of the invention, the collar is disposed, as shown in FIG. 22B, on the line conductor 71. The collar 400 comprises a formed strip of rectangular cross-section, electrically conductive material such as copper folded over four times at 406, 408, 410 and 412 to form a hollow rectangular collar. One end, 414 of the rectangular member includes a portion of peninsular material 418 bent over at 416 which is fitted or dove-tailed into a fit with an opening 420 of similar shape in the side of the wall defined by the corners 406 to 408. In a like manner a rectangular protrusion 422 depends outwardly from the horizontal section of the bent over material emanating from fold over 406 towards the right. This latter rectangular portion is interlocked with a key member or opening 424 in the fold region 412. This secure arrangement allows for a relatively strong collar member formed from a single unitary piece. There is provided at the top a threaded opening 426 into which a threaded member may be axially disposed for downward movement into the central enclosure 428 of the collar member 400 for compressing wires or conductor which may be inserted therein. The embodiment of the invention as shown in FIG. 22A includes two side mounted protrusions or trapping members 430A and 430B which transversely protrude into the central opening 428. There is also included a sprung raised portion 436 peninsularly arranged in the middle of cutout 438. The raised portion 436 is adapted for fitting into a hole as will be described later on in the line conductor 71 of the circuit interrupter.

Referring now to FIG. 22B, the collar 400 is shown in a self-retained disposition on the line conductor 71. The line conductor 71 fits between the lower portion 440 of the dowel-like protrusions 430A and 430B to trap the rectangular cross-section of the line conductor 71 therebetween and between the bottom 446 of the collar 400. The protrusion 436 protrudes upwardly into the hole 71A in the line terminal 71 thus longitudinally fixing the relationship between the collar 440 and the conductor 71. The entrapping protrusions 430A and 430B prevent the vertical movement of the collar 440 relative to the conductor 71 as viewed in FIG. 22B. Lateral movement is prevented by the location of the sidewalls shown, for example, at 450 and 452 in FIG. 22B.

What we claim as our invention is:

1. An electrical circuit interrupter, comprising:

a housing;

an operating mechanism disposed within said housing;

first and second separable main contacts disposed within said housing in a disposition of structural cooperation with said operating mechanism to b opened and closed by said operating mechanism;

trip means interconnected for opening said separable main contacts upon actuation;

an under voltage release mechanism disposed within said housing in a disposition of structural cooperation with said operating mechanism for actuating said trip means on the occurrence of an under voltage of predetermined magnitude in a circuit which is interconnected with said separable main contacts;

said under voltage release mechanism comprising a spring loaded plunger which is held in a first disposition when said voltage is greater than said predetermined magnitude and which actuates under the influence of said spring when said voltage is substantially equal or less than said predetermined magnitude, the adjustment of said spring being controlled by movable means on a shaft which abuts against one end of said spring for changing the spring force thereof to vary said predetermined magnitude; and wherein said plunger has a nut threadedly disposed thereon, said spring being a compression spring which is disposed to encircle said plunger, said spring being fixed at the end thereof which does not abut said nut.

* * * * *